US008227962B1

(12) United States Patent
Su

(10) Patent No.: US 8,227,962 B1
(45) Date of Patent: Jul. 24, 2012

(54) LED LIGHT BULB HAVING AN LED LIGHT ENGINE WITH ILLUMINATED CURVED SURFACES

(76) Inventor: Allen Hui Long Su, Vancouver (CA)

( * ) Notice: Subject to any disclaimer, the term of this patent is extended or adjusted under 35 U.S.C. 154(b) by 15 days.

(21) Appl. No.: 13/044,393

(22) Filed: Mar. 9, 2011

(51) Int. Cl.
*H01J 61/52* (2006.01)
*F21V 7/20* (2006.01)
*F21V 29/00* (2006.01)

(52) U.S. Cl. ..... 313/46; 362/294; 362/345; 362/373

(58) Field of Classification Search ..... None
See application file for complete search history.

(56) References Cited

U.S. PATENT DOCUMENTS

| | | | | |
|---|---|---|---|---|
| 6,111,274 | A | 8/2000 | Arai | |
| 6,469,437 | B1 | 10/2002 | Parthasarathy et al. | |
| 6,515,417 | B1 | 2/2003 | Duggal et al. | |
| 6,565,231 | B1 | 5/2003 | Cok | |
| 6,994,906 | B2 | 2/2006 | Burroughes et al. | |
| 7,033,850 | B2 | 4/2006 | Tyan et al. | |
| 7,166,066 | B2 | 1/2007 | Webber | |
| 7,259,030 | B2 | 8/2007 | Daniels et al. | |
| 7,288,330 | B2 | 10/2007 | Hatwar et al. | |
| 7,662,485 | B2 | 2/2010 | Begley et al. | |
| 7,758,223 | B2 * | 7/2010 | Osawa et al. | 362/547 |
| 8,025,421 | B2 * | 9/2011 | Ku | 362/231 |
| 2011/0193479 | A1 * | 8/2011 | Nilssen et al. | 315/35 |
| 2011/0292654 | A1 * | 12/2011 | Haerle | 362/235 |

FOREIGN PATENT DOCUMENTS

| | | |
|---|---|---|
| CA | 2687529 | 11/2010 |

* cited by examiner

*Primary Examiner* — Ashok Patel
(74) *Attorney, Agent, or Firm* — WPAT, P.C.; Anthony King

(57) ABSTRACT

The present invention relates to an LED light bulb utilizing LED light sheets with illuminated curved surfaces and can be used as a replacement bulb. The LED light bulb comprises an LED light engine having first and second LED modules with first and second illuminated curved surfaces facing toward different illumination zones I1, I2 respectively and attached to a thermally conducive support block with an increased curved surface area for heat dissipation. Said first and second illuminated curved surfaces are curved about first and second axes A, B respectively and are arranged to be offset from each other with said axes A and B substantially perpendicular to each other such that an improved illumination with direct lights shone to at least six different sides of the light bulb and subsequently a substantially spherical illumination of dispersed lights may be obtained along with an enhanced cooling of the light bulb.

30 Claims, 11 Drawing Sheets

LED LIGHT BULB HAVING AN LED LIGHT ENGINE WITH ILLUMINATED CURVED SURFACES

FIELD OF THE INVENTION

The present invention relates to a lighting apparatus and more particularly, to a light emitting diode (LED) light bulb utilizing either organic LED (OLED) or inorganic LED light sheets on an LED light engine to provide an improved illumination of the light bulb with direct lights shone to multiple directions and different illumination zones. The LED light bulb of the present invention may be used as a replacement of existing bulbs for both indoor and outdoor applications, such as retrofits for incandescent and fluorescent light bulbs.

BACKGROUND OF THE INVENTION

With the merits of being energy efficient and environmental friendly, LEDs are extensively used in various lighting applications including such as general lighting, backlights and signs. LED light bulbs intended to be used as replacement bulbs of traditional light sources including incandescent and fluorescent lamps are too becoming widely available. Typical LED light bulbs utilizing inorganic LED chips are, however, facing certain limitations to their design, development and implementation due to the limited angle of illumination and the high brightness point light nature as well as their sensitive performance and lifetime degradation with the increase of temperature.

It is known that the abovementioned drawbacks of LED light bulbs including at least the illumination angles as well as the cooling of LED shall be taken into consideration for the design and development of LED light bulbs. One solution to overcome the abovementioned drawbacks of LED light bulbs is described in Canadian Patent No. CA 2,687,529 (hereafter referred to as the '529 patent) entitled "LED Light Bulb with Improved Illumination and Heat Dissipation", assigned to the present inventor. The '529 patent deals with both the illumination angle and the cooling issues associated with LED lamps and discloses an LED light bulb utilizing an LED light engine to provide up and down "direct lights" and a cooling structure to facilitate the heat dissipation from the LED light engine to the ambient. One potential shortcoming of the LED light bulb 10 disclosed by the '529 patent may be related to the lateral illumination or illumination projected to the sides of the bulb as shown in FIG. 1. The lateral illumination intended to cover the lateral sides of the light bulb 10 as depicted by the shaded area S in FIG. 1 may be limited due to the existing beam angle of individual LED and module currently available (approximately 120 degree for most LEDs). Another potential shortcoming may occur during the manufacturing and selection of various different types of LEDs including both top-view and side-view LEDs. Despite the fact that side-view LEDs may be utilized to cover the lateral illumination as shown in FIGS. 2~6 of the '529 patent, such implementation involving variations of types of LEDs may, however, potentially complicate the manufacturing processes and introduce inconsistencies to the preparation and selection of LEDs of appropriate beam codes in accordance with for example 1931 CIE Chromaticity Diagram.

Organic LEDs (OLEDs), another main stream of solid state lighting in addition to inorganic LEDs, are known for their dispersed light nature and are being extensively developed as a solution for area lighting including general lighting for home and office environments. A prior OLED lighting device generally includes an organic light-emitting layer disposed between a cathode and an anode electrode, and the organic electroluminescent (EL) layer emits light upon the application of a voltage from a power source across the electrodes. The OLED device also includes a substrate comprising a material such as glass or plastic and is encapsulated with a cover; in addition, one of the two electrodes and either the cover or substrate may be made translucent to visible light spectrum to allow emitted light therethrough. Depending upon the transparency of the materials of the electrodes, the cover and/or the substrate used or selected, the OLED lighting device may be a top-emitting, a bottom-emitting or both. For example, U.S. Pat. No. 6,469,437 entitled "Highly Transparent Organic Light Emitting Device Employing a Nonmetallic Cathode" by Parthasarathy et al., U.S. Pat. No. 6,515,417 entitled "Organic Light Emitting Device and Method for Mounting" by Duggal et al., U.S. Pat. No. 6,565,231 entitled "OLED Area Illumination Lighting Apparatus" by Cok, U.S. Pat. No. 6,994,906 entitled "Flexible Substrates for Organic Devices" by Burroughes et al., U.S. Pat. No. 7,288,330 entitled "High Performance White Light-emitting OLED Device" by Hatwar et all, U.S. Pat. No. 7,662,485 entitled "White Organic Light-emitting Devices with Improved Performance" disclose examples of OLED lighting elements for large area lighting.

Efforts in the manufacturing process and method of light sheets have too made organic or inorganic LED light sheets possible and available. OLED may be manufactured in a planar form in a relatively lower cost manner comparing to inorganic LEDs. Known processes of OLED include for example, U.S. Pat. No. 7,033,850 entitled "Roll-to-sheet Manufacture of OLED Materials" by Tyan et al., U.S. Pat. No. 7,166,006 entitled "Method of Manufacturing OLED Devices by Deposition on Curved Substrates" by Cok, and U.S. Pat. No. 7,259,030 entitled "Roll-to-roll Fabricated Light Sheet and Encapsulated Semiconductor Circuit Devices" by Daniels et al. disclose examples of the fabrication of OLED light sheets. Furthermore, inorganic LED light sheet with the replacement of the abovementioned EL material of OLEDs with an inorganic material is also possible; for instance, U.S. Pat. No. 6,111,274 entitled "Inorganic Light Emitting Diode" by Arai discloses an example of the LED light sheet.

One may evidently realize the benefits of the utilization of large area lighting devices or systems in the field of general lighting; however, there are still limitations to the implementation of such large area lighting sources. One of the problems associated with such implementation of area lighting is clearly the amount of efforts and costs necessary for the replacement of existing systems and lighting fixtures in great scale. Another problem is also related to the limited illumination angles of light sheets since organic or inorganic LED light sheets in a planar form may still be of a limited illumination angle of 120~140 degrees in general and with limited "direct lights" to the lateral sides, as shown in FIG. 2A. Furthermore, the cooling of LEDs still needs to be considered, especially for high power LEDs utilizing greater currents. For solid state lighting utilizing semiconductor materials, effective cooling of LEDs is necessary since both organic and inorganic LEDs are sensitive to the increase of operating temperature; as larger current input may advantageously lead to a greater light output from the LED, but may too result in undesirable increases of the operating temperature of the LED, causing degradation of LED performance and lifetime.

In view of the above, the inventor intends to overcome the shortcomings of prior arts with the realization of the abovementioned possible drawbacks associated with large area lighting in general lighting for home and office environments. The main challenge of the present invention may be threefold: one is to provide a light source or lighting device capable of generating direct lights in multiple directions and preferably including lateral sides of the light source such that a substantially spherical illumination of dispersed lights may be obtained (the term substantially "spherical illumination" recited herein may refer to luminous-intensity distribution curve measured by for example a Goniophotometer); another is to provide an LED light bulb utilizing an LED light engine having or adapting a minimal number and/or variation of LED modules such that the aforementioned possible discrepancies or inconsistencies among LEDs may be minimized and such that preparation and manufacturing of the LED light engine may be facilitated; and the other is to provide an effective cooling to the lighting apparatus utilizing solid state lighting of semiconductor materials and preferably involving less moving parts to prevent or reduce the likelihood of component failures. Furthermore, it is desirable to provide a lighting apparatus adapting to currently existing fixtures with ease such that efforts and costs in the replacement and modification of existing systems and lighting fixtures may be reduced. The LED light bulb and components thereof provided may too be of a durable, reliable and recyclable unit. In general, the inventor intends to advantageously provide a light source for home and office environments, which may too be an alternative solution to the one provided by the abovementioned large area lightings but without extensive hardware or lighting fixture replacements or modifications; in a narrower sense, it is desirable to provide a light source such that the abovementioned shortcomings including the limited beam angles, heat dissipation and inconsistent outputs among variations of LED units of the prior arts may be overcome.

SUMMARY OF THE INVENTION

The present invention provides a novel lighting apparatus. According to one aspect of the present invention, an LED light bulb capable of providing an improved illumination having direct lights shone or projected to at least six different sides of the light bulb is provided. Such that a substantially spherical illumination with dispersed lights in multiple directions and different illumination zones may be advantageously obtained from the LED light bulb and preferably without excess uses of reflective means or modification to existing fixtures.

Another aspect of the present invention is to provide an LED light engine utilizing a minimal number and/or variation of individual LED module to minimize the inconsistency among different LED modules involved therein while providing an improved illumination. The manufacturing and preparation processes associated with the LED light engine may too be facilitated and may result in a greater consistency.

A further aspect of the present invention is to provide an LED light bulb having an effective cooling structure utilizing an increased surface area of curved illumination surfaces of an LED light engine as well as the space and structure configured therein. It is too preferably that an enhanced cooling structure or system may be provided to effectively cool the LED light engine without disturbing an improved illumination provided thereby for the LED light bulb as a whole.

A still further aspect of the present invention is to provide an LED light bulb having a mechanical structure involving less moving parts to prevent or reduce the likelihood of component failures as well as to facilitate manufacturing assembly, component preparation and parts recycling while providing an improved illumination with effective cooling.

According to one embodiment of the present invention, an LED light bulb having an LED light engine with illuminated curved surfaces is advantageously provided such that an improved illumination is obtained. The improved illumination includes direct lights shone or projected to at least six different sides associated with different illumination zones of the LED light bulb such that a substantially spherical illumination of dispersed lights from the LED light bulb as a whole may be obtained. Accordingly, the LED light bulb of the present invention encompassed by first and second illumination zones may comprise an LED light engine having first and second LED modules with illuminated curved surfaces facing toward said first and second illumination zones respectively. The LED light bulb may also comprise a light transmissive shell and a thermally conductive support block having projected surfaces formed thereon for the attachment of the LED light engine. The first and second LED modules of the LED light engine may be advantageously made or fabricated from curved organic or inorganic LED light sheets that may be of flexible or rigidly curved substrates. The first and second LED modules of the LED light engine may preferably be further configured and arranged in a novel way to provide the desired and improved illuminations. In an explanatory example, the first and second LED modules of the LED light engine may be preferably arranged to be at an angle to each other such that direct lights form the first and second LED modules of the LED light engine may be projected or shone to said first and second illumination zones respectively.

According to another embodiment of the present invention, an LED light bulb utilizing high power LED modules with illuminated curved surfaces as an LED light engine with an enhanced cooling structure is provided. The light transmissive shell of the LED light bulb may preferably include first and second envelopes attached to a thermally conductive support block onto which the LED light engine having an increased illuminated surface area may be attached. Likewise, the LED light engine may further comprise first and second LED modules with illuminated curved surfaces curved about first and second center axes respectively to provide an improved illumination in multiple directions. The first center axis of the first illuminated curved surface of the first LED module may preferably be substantially perpendicular to the second center axis of the second illuminated curved surface of the second LED module such that direct lights may be shone or projected to at least six different sides of first and second illumination zones of the light bulb. In an explanatory example, said first illumination zone may include at least the top and two lateral sides, such as left and right, of the light bulb and said second illumination zone may include at least the bottom and the other two lateral sides, such as front and rear, of the light bulb. Furthermore, additional air channels may be provided to enhance the heat dissipation of the high power LED light engine. The air channels may be advantageously provided on first and second envelops of the shell of the light bulb to allow ambient air to flow therethrough, preferably without disturbing the improved illumination provided by the LED light engine for the light bulb as a whole and preferably without the excess use of moving parts.

According to still another embodiment of the present invention, an LED light bulb utilizing an LED light engine with illuminated curved surfaces and having a thermally conducive support block further extending toward and secured to the base of the light bulb for enhanced structural stability and heat dissipation is provided. The thermally conductive support block may further include a central stem extending toward and secured to a base of the light bulb. In addition, the LED light engine attached thereon may be structurally configured to have different orientations adapting to different sizes and shapes of bulb shells while providing an improved illumination with direct lights shone to multiple directions of different illumination zones. Furthermore, in one explanatory example, a first LED module of the LED light engine may provide direct lights to said top, left and right sides of the light bulb and a second LED module of the LED light engine may provides direct lights to said bottom, front and rear sides thereof. In another explanatory example where the LED light engine may be configured in a different orientation, a first LED module of the LED light engine may provide direct lights to said front, left and right sides of the light bulb and a second LED module thereof may provide direct lights to said rear, top and bottom sides of the light bulb.

BRIEF DESCRIPTION OF THE DRAWINGS

The foregoing and other features and advantages of the invention will be more fully understood from the following descriptions of various embodiments of the invention and the accompanying drawings. In the drawings like reference numerals generally refer to similar elements throughout. The drawings are not necessarily to scale, emphasis instead being placed upon illustrating the principles of the invention.

DESCRIPTION OF EMBODIMENTS OF THE INVENTION

An LED light bulb of the present invention is compatible with existing sockets for incandescent, filament or fluorescent light bulb and utilizes LED light sheets to provide direct lights in multiple directions projected outwardly from the LED light bulb. It may be preferable that the direct lights of an LED light engine of the LED light bulb of the present invention may be emitted or projected to at least six different sides of illumination zones of the LED light bulb such that a substantially spherical illumination may be obtained or achieved without excess use of reflective means. It may too be preferable that the structure of the LED light bulb of the present invention facilitates or enhances the cooling of the LED light engine without excess use of moving parts.

Figure 1:
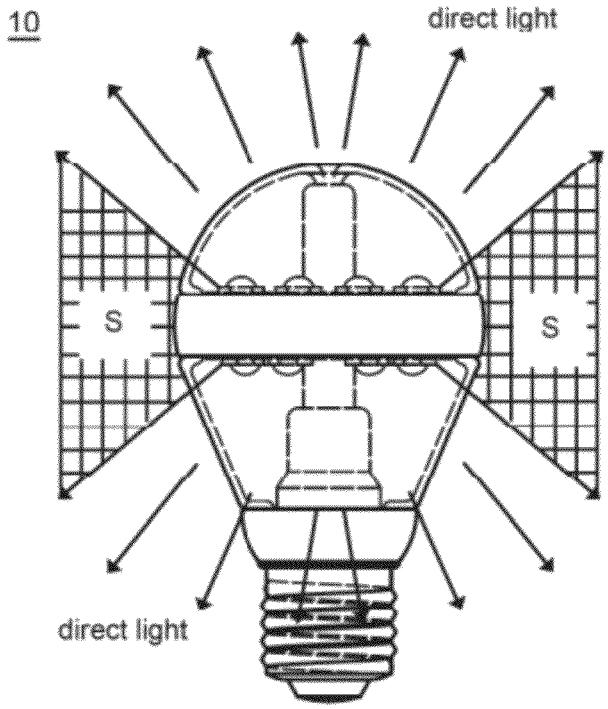
FIG. 1 ( Prior Art )
FIG. 1 is a schematic illustration showing a prior LED light bulb of the '529 patent of the present inventor.
Figure 2A:
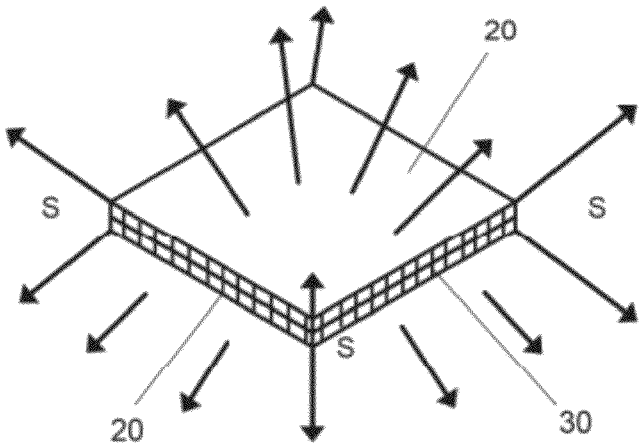
FIG. 2A is a schematic view of an example of an LED light sheet in a planar form.
Figure 2B:
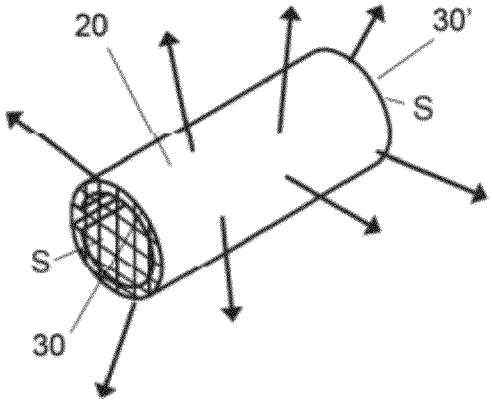
FIG. 2B is a schematic view of an LED light sheet forming a cylindrical column.
Figure 2C:
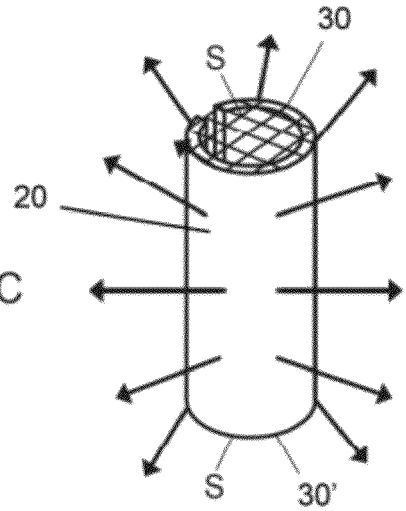
FIG. 2C is a schematic view of an LED light sheet forming another cylindrical column in a longitudinal direction.
Figure 2D:
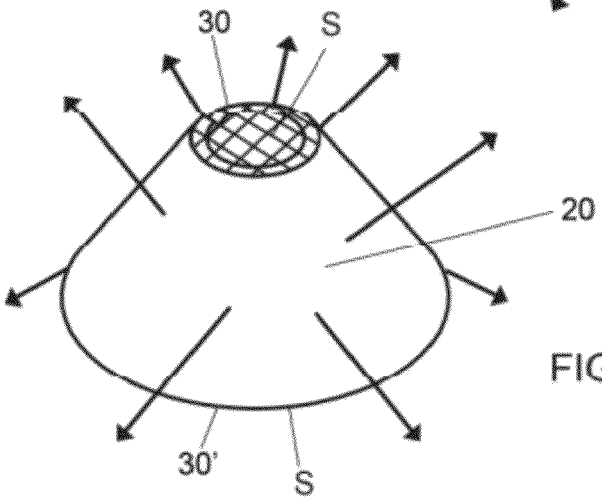
FIG. 2D is a schematic view of an LED light sheet forming a conical frustum.
Figure 2E:
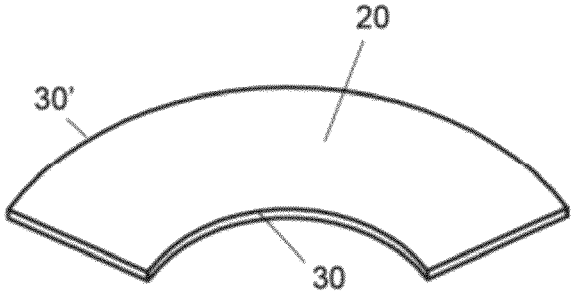
FIG. 2E is a schematic view of the LED light sheet of FIG. 2D flattened to a planar fan shape.

FIGS. 2A~2E show some examples of LED light sheets having certain limitations in the illumination angles and in the feasibility of application as an LED light source or engine. As previously mentioned, FIG. 2A discloses an LED light sheet in a planar form with limited direct lights to the lateral sides 30 thereof. It may be apparent that for a transparent light sheet or a more advanced light sheet having both top and bottom emitting sides, the lateral sides 30 may still be devoid of direct lights as shaded area S. Despite the fact that curved LED light sheets may be advantageously provided to obtain a wider angle of illumination, efforts are still necessary to overcome the shortcoming in illumination angles. FIGS. 2B and 2C demonstrate a curved light sheet in a form of a cylindrical column having an illuminated surface 20. As the edges 30, 30' of the curved light sheet are of limited direct lights shown in the shaded areas S, it may too be apparent that additional LED modules or units must be provided adjacent to the edges 30, 30' of the curved light sheet for greater and wider illumination. FIG. 2D is another example of an LED light sheet curved into a conical frustum shape. Likewise, additional LED modules or units must be provided adjacent to the edges 30, 30' for greater and wider illumination. Another drawback with the curved LED light sheet of FIG. 2D is that the corresponding flatted sheet in a fan shape, as shown in FIG. 2E, may not be optimal for the production of such light sheets in terms of the availability of the technology and costs. It too can be understood that similar shapes and forms of LEDs may be possible; however, most of them tend to be either of complicated shapes that are unlikely in terms of manufacturing processes or costs or of various LED units that are unfavorable to material preparation or performance consistency. In short, utilizing the abovementioned curved light sheets or similar shapes and forms thereof as an LED light engine or source may be unfavorable and may still fail to produce an improved illumination with direct lights shone to at least six different sizes thereof.

Figure 3:
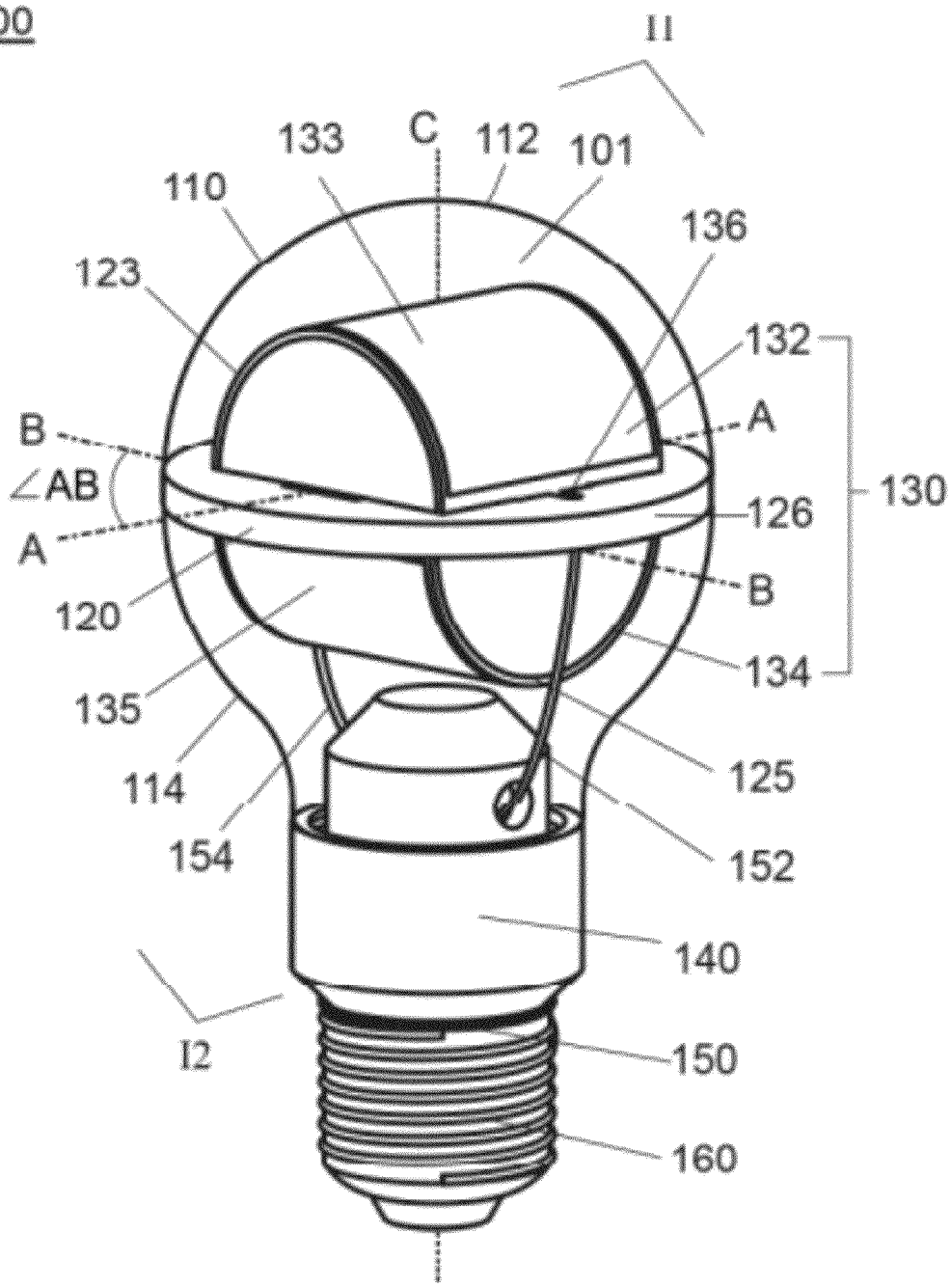
FIG. 3 is a perspective view of an embodiment of an LED light bulb of the present invention.
Figure 4:
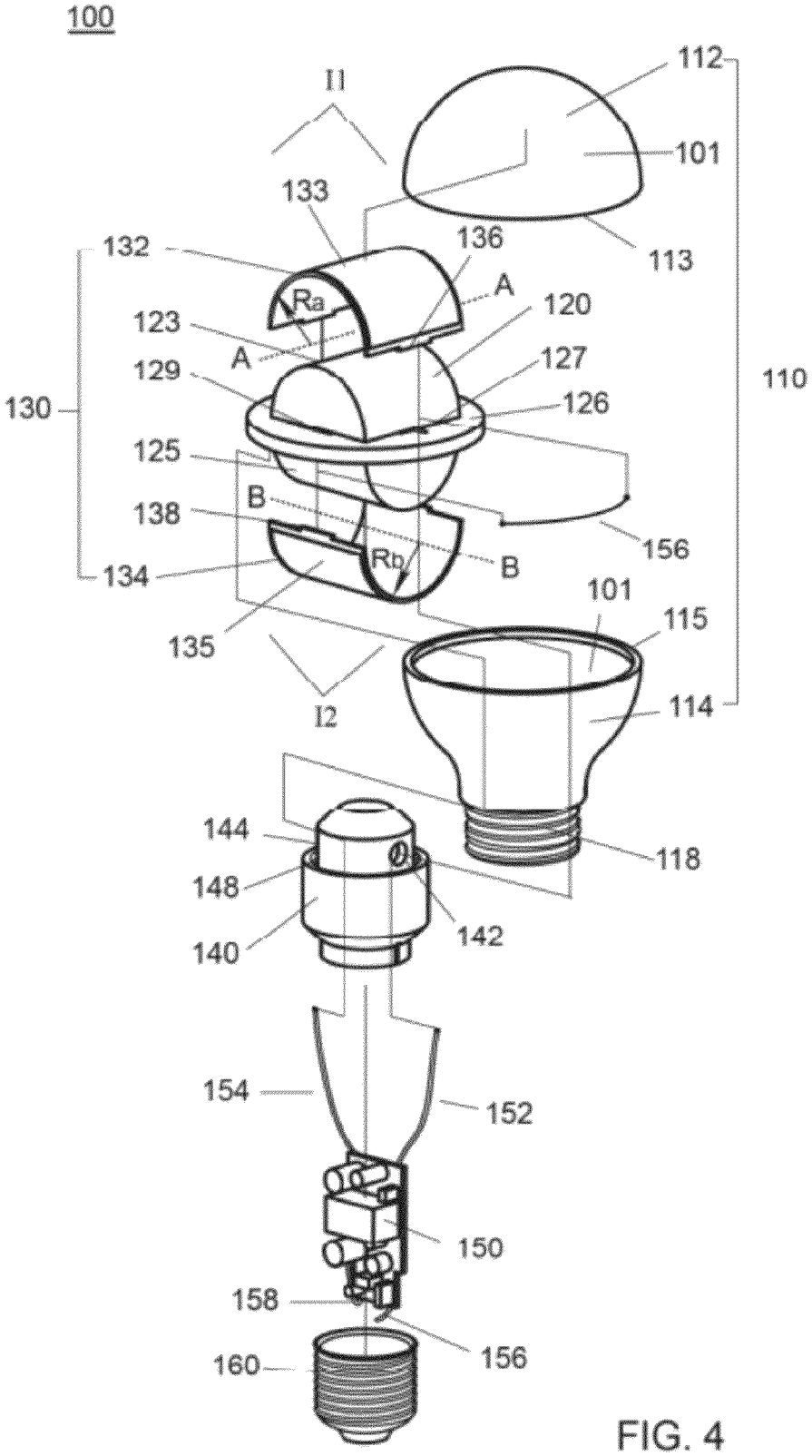
FIG. 4 is an exploded view of the LED light bulb in FIG. 3.

In view of the above and shortcomings of the prior arts, the present invention provides an LED light bulb utilizing a novel LED light engine with enhanced illumination, structural stability with increased surface areas or configurations for cooling. According to one exemplary embodiment of the present invention as shown in FIGS. 3 and 4, an LED light bulb 100 comprises a light transmissive shell 110 defining an inner space 101 encompassed by a first illumination zone I1 and a second illumination zone I2 and an LED light engine 130 arranged on a thermally conductive support block 120. Said LED light engine 130 comprises a first LED module 132 attached to a first projecting surface 123 of the support block 120 and a second LED module 134 attached to a second projecting surface 125 of the support block 120. The first LED module 132 further comprises a first illuminated curved surface 133 facing toward the first illumination zone I1; whereas the second LED module 134 further comprises a second illuminated curved surface 137 facing toward said second illumination zone I2. In order to provide an improved illumination having direct lights shone or projected to at least six different sides of the first and second illumination zones such that an overall substantially spherical illumination of dispersed lights may be obtained, the first LED module 132 may be curved or arched about a first center axis A and extending along said first center axis A, and the second LED module 134 may be curved or arched about a second center axis B and extending along said second center axis B; and wherein said first center axis A may be preferably arranged at an angle ∠AB with said second center axis B such that the first illumination zone I1 covered by direct lights projected from the first LED module 132 may then be different from the second illumination zone I2 covered by direct lights projected from the second LED module 134. Moreover, heat generated by the LED light engine 130 of the LED light bulb 100 may be effectively dissipated away from the light engine or heat source via the conductive support block 120 having an increased dissipation area of curved surfaces as well as the structural configurations thereof including such as circumferential areas adjacent to the light bulb to facilitate heat conduction and radiation.

The light transmissive shell 110 of the LED light bulb 100 of the present invention utilizing an LED light engine 130 having first and second LED modules 132, 134 with illuminated curved surfaces 133, 135, in an explanatory example, may further comprise first and second envelopes 112, 114 enclosing an inner space 101 thereof. By providing a bulb shell 110 having first and second envelopes 112, 114, an LED light engine 130 of desired dimensions or sizes may be advantageously configured to be of an optimal size fitted to various shapes and sizes of bulb shells. In another example, the bulb shell 110 may be further treated to be of a frosted surface to further refract, reflect and/or deflect lights to dispersed lights. It can be understood that the bulb shape disclosed by FIGS. 3 and 4 is provided for illustrative purposes only and other forms and shapes such as the ones adapting to standards including A/G/PS type bulbs of various sizes and dimensions are also possible and within the spirit and scope of the present invention.

The first and second LED modules 132, 134 of the LED light engine 130 of the LED light bulb 100, according to one embodiment of the present invention, may utilize LED light sheets with illuminated curved surfaces 133, 135 such that an improved illumination may be obtained. As previously mentioned, the first illuminated curved surface 133 of the first LED module 132 may be curved or arched about a first center axis A and extending along said first center axis A, and the second illuminated curved surface 13 of the second LED module 134 may too be curved or arched about a second center axis B and extending along said second center axis B. In an explanatory example as shown in FIG. 4, the first illuminated curved surface 133 of the first LED module may preferably be of a first half-cylindrical shape curved about said first center axis A with a first radius Ra, and said second illuminated curved surface 135 of the second LED module 134 may preferably be of a second half-cylindrical shape arched about said second center axis with a second radius Rb. Furthermore, said first center axis A may preferably be arranged at an angle ∠AB with said second center axis. In another explanatory example, said angle ∠AB between the first and second center axes of the first and second illuminated curved surfaces 133, 135 of the first and second LED modules 132, 134 may preferably be substantially equivalent to 90 degrees such that said illumination zones I1, I2 include first and second sets of the at least six different sides of the LED light bulb 100 different from each other. It too can be understood that other degree of said angle ∠AB, such as an angle between 30 and 150, is also possible. In another explanatory example, said angle ∠AB may be formed on a plane substantially perpendicular to said longitudinal axis C of the light bulb 100. In still another explanatory example, the abovementioned first illumination zone I1 may include at least a portion of top, left and right sides of the light bulb 100 with respect to a longitudinal axis C thereof; whereas the second illumination zone I2 different from said first illumination zone I1 may include at least a portion of bottom, front and rear sides of light bulb with respect to said longitudinal axis C thereof. Further illustrations and details of the first and second sets of the at least six different sides of the first and second illumination zones different from each other are provided in the later content.

The thermally conductive support block 120 of the LED light bulb 100 of the present invention may be provided and configured to facilitate the heat dissipation and securement of the LED light engine 130 attached thereon. According to one embodiment of the present invention as shown in FIGS. 3 and 4, the support block 120 may further comprise a first projecting surface 123 and a second projecting surface 125, and wherein said first projecting surface 123 may include a first outwardly-projecting convex profile toward the first illumination zone I1 and said second projecting surface 125 may include a second outwardly-projecting convex profile toward the second illumination zone I2. In an explanatory example, the first and second projecting surfaces 123, 125 of the support block 120 may be of convex profiles substantially coincide with the shapes of the illuminated curved surfaces 133, 135 of the first and second LED modules 132, 134 of the LED light engine 130 to facilitate the attachments thereon and heat transfer thereto. Furthermore, to enhance the structural stability of the LED light engine 130 and the support block 120, longitudinal extensions may be further provided and attached to the base of the light bulb 100. An additional light transmissive protective cover (not shown), preferably of a curved profile substantially coincide with the one of the illuminated curved surfaces of LED modules 132, 134, may too be further provided to cover at least a portion of the LED light engine 130 on the support block 120 to enhance the securement and protection thereon. The support block 120 may further comprise a thermally conductive central plate 126 configured or formed between said first and second projecting surfaces 123, 125, allowing further attachment or securement of the first and second envelopes 112, 114 of the bulb shell 110 thereon to enhance an overall structural stability of the light bulb and such that heat transfer or dissipation from the LED light engine 130 or heat source via the increased surface area of the support block 120 and further to the shell 110 as whole may be further facilitated.

For a structural assembly including electrical connections of the LED light bulb 100 according to one embodiment of the present invention, the LED light engine 130 may preferably be arranged or secured between the first and second envelopes 112, 114 of the shell 110 of the light bulb and eclectically connected to an internal circuitry 150 of a base 140 of the light bulb. As shown in the FIGS. 3 and 4, the first and second LED modules 132, 134 of the LED light engine 130 may further include first and second sets of electrodes 136, 138 respectively and electrically connected to each other via an electrical connection such as a lead wire 156 arranged on the support block 130. An internal circuitry 150 may be received within the base 140 and lead wires 152, 154 of the internal circuitry 150 may be electrically connected to the electrodes sets 136, 138 of the first and second LED modules of the LED light engine 130 via such as perforations 142, 144 formed on said base 140. To facilitate the electrical connections as well as securement of the electrodes and lead wires thereon, in an explanatory embodiment, the support block 130 may be further formed of slots 127, 129 to receive said electrode sets 136, 138 of the first and second LED modules and to facilitate the electrical connection of the lead wires 152, 154 of the internal circuitry 150 thereto. Various means of attachment of components may be possible; for example, the LED modules 132, 134 may be attached to the projecting surfaces 123, 125 of the support block 120 by means of for example, adhesives, press fitting, fixations such as screws and bolts and so forth. In addition, the first and second envelopes 112, 114 of the shell 110 may too be attached to the support block 130 at the respective end openings or edges 113, 115 by means of for example, adhesives, fastening threads, slots and locks and fixations such as screws and bolts and so forth. Likewise, the bottom opening or edge 118 of the shell 110 may be further attached to a attachment portion 148 of the base 140 by means of for example, adhesives, fastening threads, slots and locks and fixations such as screws and bolts and so forth. The previously mentioned adhesives may preferably be heat conductive adhesives to facilitate heat transfer, in particular, heat conduction of adjoined components. In addition, it can be understood that the first and second LED modules 132,134 of the LED light engine 130 may preferably be connected in either series or parallel depending upon the power consumption utilized and the current required for each one of the LED modules to provide an overall illumination output of desired power for the LED light bulb. It can also be understood that the socket 160 electrically connected to the internal circuitry 150 and to the LED light engine 130 via lead wires 156, 158 thereof may too be of any type of sockets including such as Edison or pin-type sockets.

Figure 5:
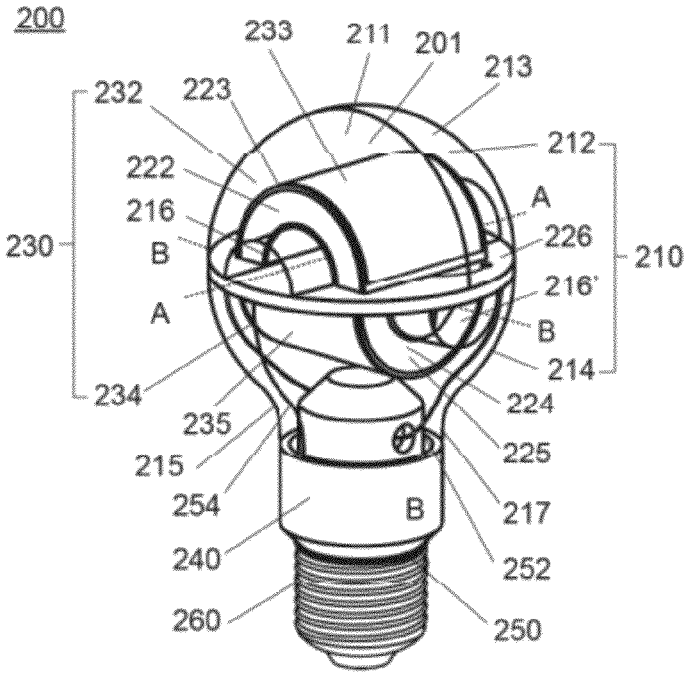
FIG. 5 is a perspective view of another embodiment of an LED light bulb of the present invention.
Figure 6:
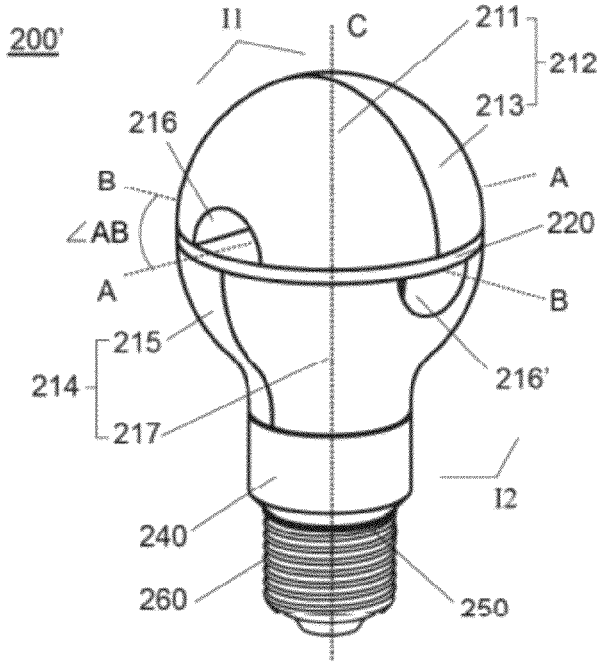
FIG. 6 is a perspective view of the LED light bulb in FIG. 5 having a frosted shell.
Figure 7:
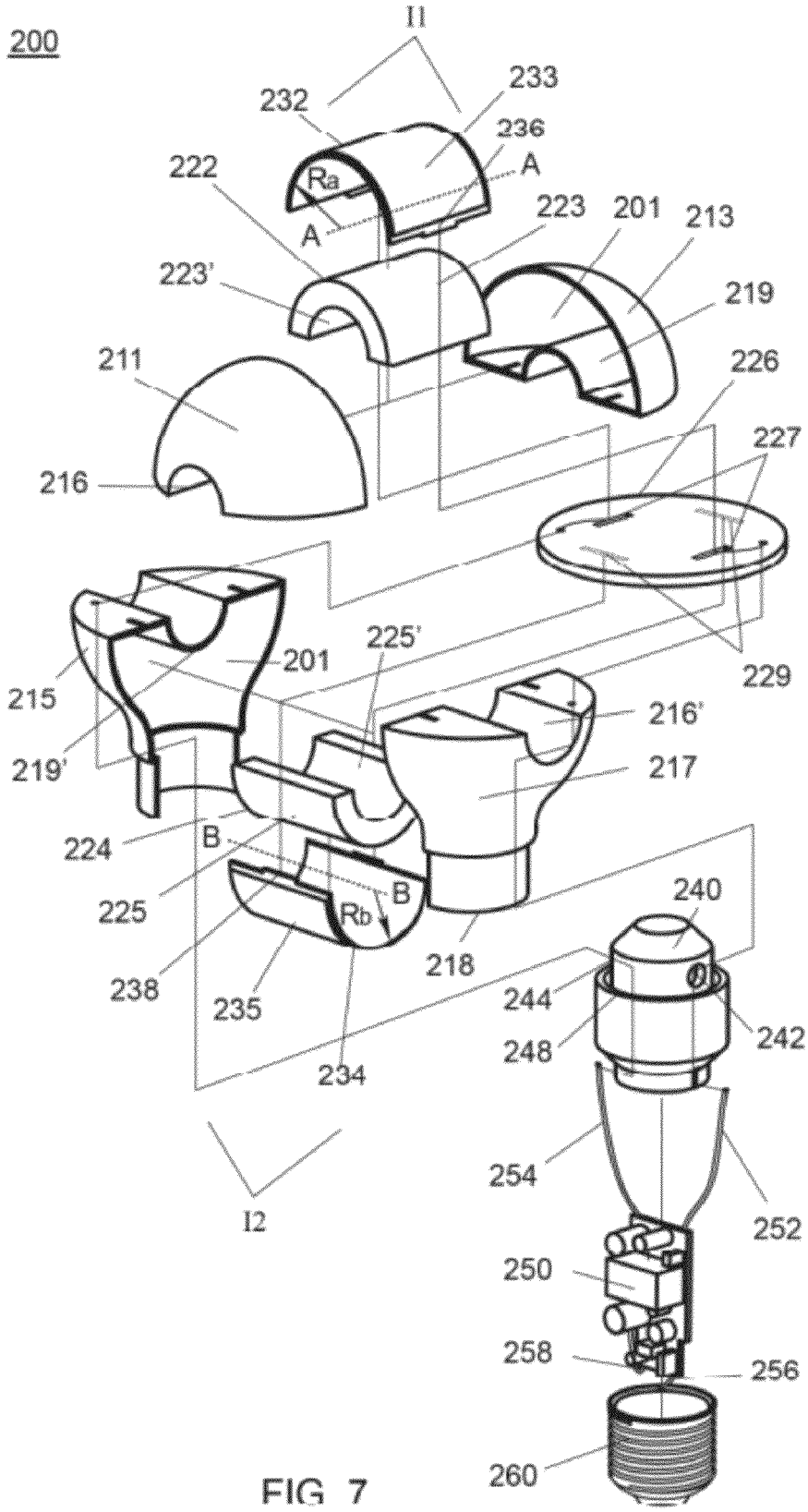
FIG. 7 is an exploded view of the LED light bulb in FIGS. 5 and 6.

FIGS. 5, 6 and 7 show another exemplary embodiment of an LED light bulb 200 of the present invention. To enhance the heat dissipation of the LED light bulb 200 utilizing a high power LED light engine 230 of the present invention, additional air channels 216, 216' may be configured and provided on the LED light bulb 200, preferably without disturbing the improved illumination of the LED light bulb 200. As shown in FIGS. 5 and 7, the LED light bulb 200 encompassed by a first illumination zone I1 and a second illumination zone I2 different said first illumination zone I2 may comprise a light transmissive shell 210 defining an inner space 201 enclosed by a first envelope 212 and a second envelope 214, and wherein said first and second illumination zones I1, I2 thereof may include first and second sets of at least six different sides of the first and second illumination zones I1, I2 of the light bulb. In an explanatory example, the said first and second envelopes 212, 214 of the shell 210 may be arranged to be an upper part and a lower part of the light bulb along a longitudinal axis C of the light bulb 200 respectively. Furthermore, additional air channels 216, 216' may be advantageously configured and provided on the LED light bulb 200 and adjacent to the LED light engine 230 enclosed therein to enhance the heat dissipation away therefrom. To facilitate the structural arrangement or configuration of the air channels 216, 216' on the bulb shell 210 without disturbing the improved illumination provided by the LED light engine 230 thereof, in an explanatory example, said first and second envelopes 212, 214 of the shell 210 may respectively further comprise a first-half piece 211, 215 and a second-half piece 213, 217 adjoined to each other along the longitudinal axis C of the light bulb 200; furthermore, the thermally conductive support block 230 may further include first and second conducive blocks 222, 224 configured in accordance with the arrangement of the air channels 216, 216' provided adjacent to the LED light engine 230 and formed on the bulb shell 210. The bulb shell 210 of the LED light bulb 200 may further comprise at least one inwardly convex profile 219, 219' projecting toward said inner space 201 thereof and configured on said first and second envelopes 212, 214 such that the first and second conducive blocks 222, 224 of the support block 220 may then be further attached onto said inwardly convex profile 219, 219' of the first and second envelopes 212, 214 of the shell 220. Accordingly, said first conductive block 222 of the support block 220 having a first projecting surface 223 formed thereon for the attachment of the first LED module 232 with a first illuminated curved surface 233 and said second conductive block 224 of the support block 220 having a second projecting surface 225 formed thereon for the attachment of the second LED module 234 with a second illuminated curved surface 235 may be advantageously provided. Each of said first and second conductive blocks 222, 224 may further include a curved surface 223', 225' configured to substantially coincide with said at least one inwardly convex profile 219, 219' on said first and second envelops 212, 214 of the shell 210. By providing such explanatory configuration of the support block 230 and envelopes 212, 214 of the shell 210 as shown in FIGS. 4~6, the support block 220 onto which the LED light engine 230 is attached may encompass or cover at least a portion of the air channels 216, 216' adjacent to the LED light engine 230 as well as the support block 220 such that heat may be dissipated or transferred away from the LED light engine or heat source without disturbing the illumination provided thereby. The heat transfer path may be for example from the high power LED modules 232, 234 of the LED light engine 230 to the support block 220 and subsequently via the bulb shell 210 as a whole and with ambient air flowing through the air channels 216, 216' configured adjacent to the LED light engine 230 and support block 220 for an enhanced cooling thereof.

Similarly, the LED light bulb 200 of present invention is also capable of providing an improved illumination having direct lights shone or projected to at least six different sides of first and second illumination zones of the light bulb such that a substantially spherical illumination of dispersed lights of the light bulb as a whole may be advantageously obtained. As mentioned previously, a high power LED light engine 230 comprising a first and a second LED module 232, 234 may be attached to said support block 220. The first LED module 232 may be attached to the first projecting surface 223 of the first conductive block 222 of the support block 220 and the second LED module 234 may be attached to the second projecting surface 225 of the second conducive block 224 thereof. The first and second LED moulds 232, 234 may too include first and second electrode sets 236, 238 electrically connected to each other via electrical connections such as lead wires 256, formed on a central plate 226 of the support block 220. In addition, a central plate 226 of the support block 220 may be preferably configured or formed between the first and second conducive blocks 222, 224 thereof and may too further include slots 227, 229 to facilitate the securement and electrical connections of the electrode sets 236, 238 of the first and second LED modules 232, 234 of the LED light engine 230 thereon. As shown in FIGS. 5 and 7 again, the abovementioned first projecting surface 223 of the support block 220 may include a first outwardly-projecting convex profile toward the first envelope 212 of the shell 210 in said first illumination zone I1, and the second convex surface 225 of the support block 220 may include a second outwardly-projecting convex profile toward said second envelope 214 of the shell 200 in the second illumination zone I2. Furthermore, the first illuminated curved surface 233 of the first LED module 232 attached to the support block 220 and facing toward the first illumination zone I1 may be curved about a first center axis A and extending along said first center axis A; the second illuminated curved surface 235 of the second LED module 234 attached to the support block 220 and facing toward said second illumination zone I2 may be curved about a second center axis B and extending along said second center axis B. To obtain a substantially spherical illumination having direct lights shone or projected to at least six different sides of the first and second illumination zones I1, I2 of the LED light bulb 200, said first center axis A of the first illuminated curved surface 233 may be arranged at an angle ∠AB with said second center axis B of the second illuminated curved surface 235. Likewise, in an explanatory embodiment, said angle ∠AB between the first and second center axes A, B may be substantially equivalent to 90 degrees. It too can be understood that other degree of said angle ∠AB, such as an angle between 30 and 150, is also possible. In an explanatory example, said angle ∠AB may be formed on a plane substantially perpendicular to said longitudinal axis C of the light bulb 200. The light transmissive shell 210 including the first and second envelopes 212, 214 as well as first and second half pieces thereof may also be surface-treated to be frosted surfaces, as shown in FIG. 6, such that the direct lights shone to said at least six different sides of the first and second illumination zones I1, I2 of the light bulb may be further refracted and reflected.

For the assembly and electrical connections of the LED light bulb 200 according to one embodiment of the present invention, the first and second LED modules 232, 234 of the LED light engine 230 attached to the first and second conducive block 222, 224 of the support block 220 may be further secured to the central plate 226 of the support block 220 and enclosed by the first and second envelopes 212, 214 adjoined by first and second half pieces of the shell 210 respectively. The first and second LED modules 212, 214 may be curved about said first and second center axes A, B with radii Ra, Rb respectively and may be electrically connected to an internal circuitry 250 via electrical connections such as lead wires 252, 254 extending from the base 240 of the LED light bulb 200 of the present invention. To facilitate the electrical connections, perforations, such as 242, 244, may be configured or formed on parts of the base 240, central plate 226 of the support block 220 and the shell. 210 As previously mentioned, the attachments of the LED modules, support block and shell may be achieved by means of for example adhesives, fastening threads, press-fitting, slots and locks and fixations such as screws and bolts and so forth. It too can be understood that parts of the shell in multiple pieces, such as pieces 211, 213 of the first envelope 212 and pieces 215, 217 of the second envelope 214, may be adjoined to each other by means of for example, thermal fusion, adhesives and fixations such as screws, bolts and so forth. Similarly, the first and second LED modules 232, 234 of the LED light engine 230 may preferably be connected in either series or parallel depending upon the design of the power consumption utilized and the current required for each of the LED modules to provide an illumination output of desired power of the LED light bulb 200. It can also be understood that the socket 260 electrically connected to the internal circuitry 250 and to the LED light engine 230 via lead wires 256, 258 thereof may too be of any type of sockets including such as Edison or pin-type sockets.

Figure 8:
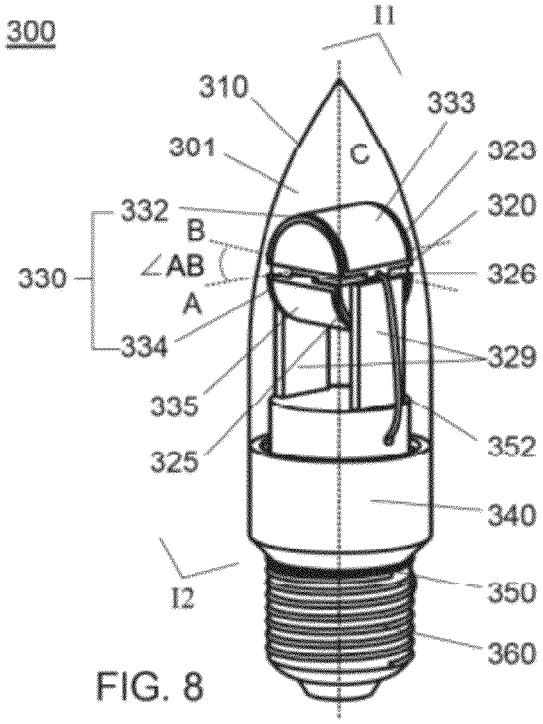
FIG. 8 is a perspective view of still another embodiment of an LED light bulb of the present invention.
Figure 9:
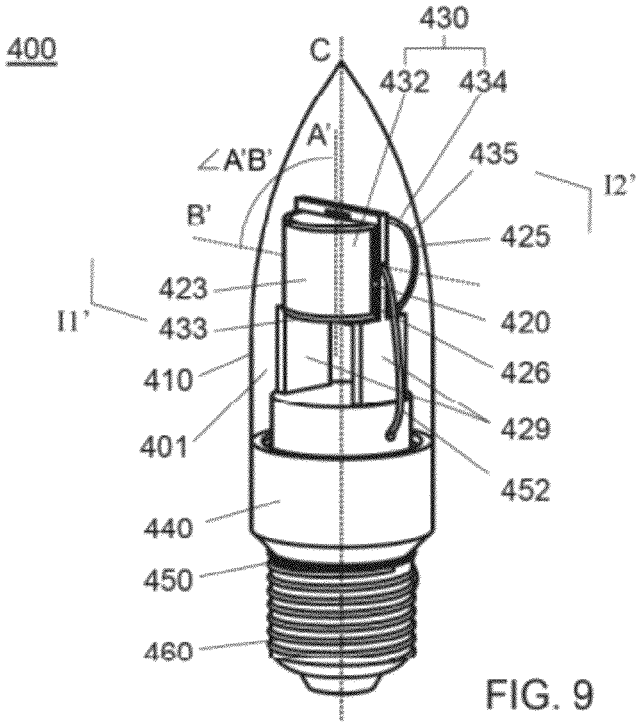
FIG. 9 is a perspective view of still another embodiment of an LED light bulb of the present invention.
Figure 10:
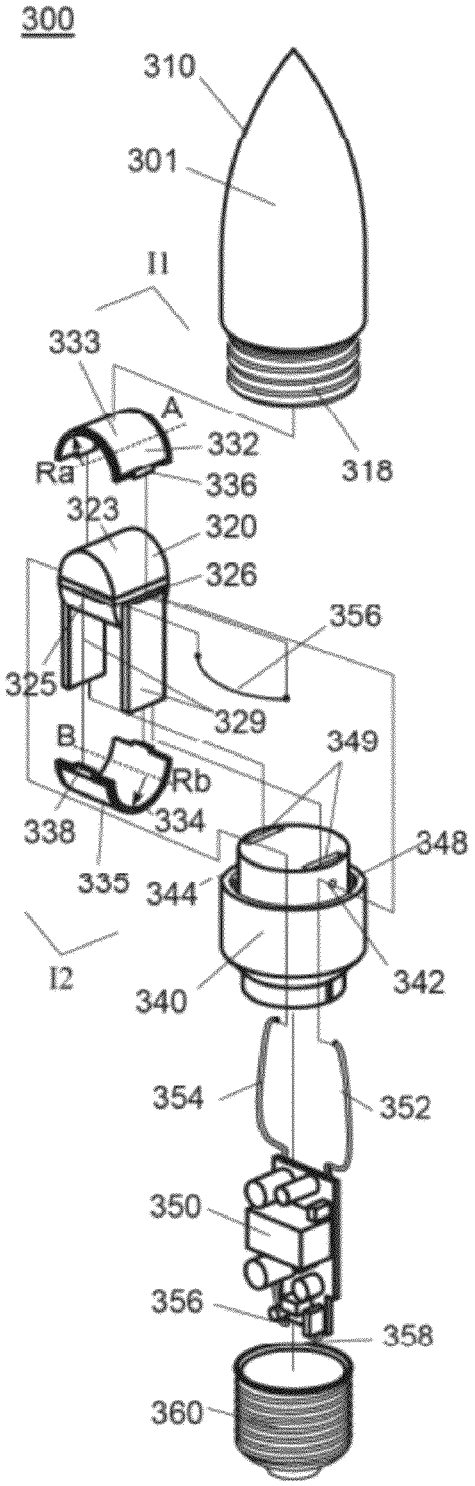
FIG. 10 is an exploded view of the LED light bulb in FIG. 8.

FIGS. 8~11 disclose further exemplary embodiments of an LED light bulb of the present invention with improved illumination and heat dissipation. Referring now to FIGS. 8 and 10, there are depicted an LED light bulb 300 encompassed by a first illumination zone I1 and a second illumination zone I2 different from said first illumination zone I1 and comprising an LED light engine 330 having first and second LED modules 332, 334 attached to a thermally conducive support block 320 further extending toward and secured onto a base 340 of the light bulb along a longitudinal axis C thereof. In an explanatory example, the LED light engine 330 may preferably be enclosed by a light transmissive shell 310 within an inner space 301 thereof. Accordingly, the shell 310 may adjoined or attached to the base 340 along the longitudinal axis C of the light bulb 300 and the base 340 onto which the abovementioned support block 320 is secured may further comprise a supporting stand 348 configured to include fixation means 349 thereon for the securement of at least a portion of the support block 320. It too can be understood that the bulb shapes disclosed by FIGS. 8~11 are provided for illustrative purposes only and other forms and shapes such as the ones adapting to standards including A/G/PS type bulbs of various sizes and dimensions are possible and are also within the spirit and scope of the present invention.

To enhance the structural stability and to facilitate the heat transfer of the LED light bulb 300, the thermally conductive support block 320 comprising a first projecting surface 323 and a second projecting surface 325 may further include a central stem 329 extending away from said first and second projecting surfaces 323, 325 along the longitudinal axis C of the light bulb 300 and secured to said supporting stand 348 of the base 340. Said first projecting surface 323 of the support block 320 may further include a first outwardly-projecting convex profile toward the first illumination zone I1, and said second projecting surface 323 thereof may further include a second outwardly-projecting convex profile toward the second illumination zone I2 different from the first illumination zone I1. The supporting stand 348 of the base 340 of the light bulb 300 may be provided to facilitate the fixation or securement of the central stem 329 of the support block 320 thereon and to enhance the heat transfer or dissipation from the LED light engine 330 on the support block 320 via the central stem 329 thereof to the base 340 and the bulb shell 310 of the light bulb and to the ambient. In an explanatory example, the supporting stand 348 may be integrally formed with the base 340 as one piece, configured to receive the central stem 329 of the support block 320 thereon; in another explanatory example, the central steam 329 of the support block 320 and the supporting stand 348 of the base 340 may too be integrally form as one piece for a further enhanced structural configuration of the light bulb. In addition, the support block 320 may further include a central plate 326 configured between said first and second projecting surfaces 323, 325 such that the electrical connection, for example lead wire 356, may be attached or formed thereon to electrically connect electrode sets 336, 338 of the first and second LED modules 332, 334 of the LED light engine 330.

As shown in FIGS. 8 and 10 again, the LED light engine 330 attached to the support block 320 of the LED light bulb 300 according to an exemplary embodiment of the present invention may be configured to provide an improved illumination having direct lights shone or projected to at least six different sides of first and second illumination zones I1, I2 of the LED light bulb 300 of the present invention such that a substantially spherical illumination of dispersed lights may be advantageously obtained. The first LED module 332 of the LED light engine 330 may be attached to a first projecting surface 323 of the support block 320 and the second LED module 324 may be attached to a second projecting surface 325 of the support block 320. In an explanatory example, the first LED module 332 may further comprise a first illuminated curved surface 333 facing toward the first illumination zone I1, curved about a first center axis A with a first radius Ra and 3 and extending along said first center axis A; the second LED module 334 may further comprise a second illuminated curved surface 335 facing toward said second illumination zone I2, curved about a second center axis B with a second radius Rb and extending along said second center axis B. Similarly, the first and second LED modules 332, 334 of the LED light engine 330 may be arranged and configured in a novel way to provide direct lights to at least different sides of the first and second illumination zones of the LED light bulb 300. In another explanatory example, the first center axis A of the first illuminated curved surface 333 of the first LED module 332 may be arranged at an angle ∠AB with the second center axis B of the second illuminated curved surface 335 of the second LED module 334; furthermore, said angle ∠AB may preferably be substantially equivalent to 90 degrees. It too can be understood that other degree of said angle ∠AB, such as an angle between 30 and 150, is also possible. In another explanatory example, said angle ∠AB may be formed on a plane substantially perpendicular to said longitudinal axis C of the light bulb 300. In still another explanatory example, the first illuminated curved surface 333 of the first LED module 332 may be of a first half-cylindrical shape curved about said first center axis A with the abovementioned first radius Ra, and said second illuminated curved surface 335 of the second LED module 334 may be of a second half-cylindrical shape curved about said second center axis B with the abovementioned second radius Rb. Subsequently, an improved illumination of the LED light bulb 300 utilizing said LED light engine 330 therein may be advantageously obtained and such that said first illumination zone I1 may include for example direct lights shone or projected to at least a portion of top, left and right sides of the light bulb 300 with respect to said longitudinal axis C of the light bulb 300 and said second illumination zone I2 different from said first illumination zone I1 may include for example direct lights shone or projected to at least a portion of bottom, front and rear sides of light bulb 300 with respect to said longitudinal axis C of the light bulb 300.

As for the assembly and electrical connections of the LED light bulb 300 of the present invention, components of the light bulb may be electrically connected to each other via such as lead wires and may too be attached or adjoined to each other by means of for example adhesives, fastening threads, press-fitting, slots and locks and fixations such as screws and bolts and so forth. The first and second LED modules 332, 334 of the LED light engine 330 attached to the thermally conducive support block 320 may also include first and second electrode sets 336, 338 formed thereon respectively and may too be electrically connected via for example lead wire 356, which may be further connected to an internal circuitry 350 via such as lead wires 352, 354 thereof. As previously mentioned, the central stem 329 of the support block 320 may be secured or attached to the supporting stand 348 of the base 340 via such as fixation portions 349 thereof by means of for example adhesives, press-fitting, slots and locks and fixations such as screws and bolts and so forth. The supporting stand 348 of the base 340 and the central stem 329 of the support block 320 may too be integrally formed as one piece by ways of for example, molding, injection or extrusion to enhance the structural stability and to facilitate the heat dissipation from the LED light engine 330 and the support block 320. Furthermore, the base 340 as well as the support block 320, or the central plate 326 thereof, may further include perforations 342, 344 configured thereon to facilitate the electrical connections, such as lead wires 352, 354 to pass therethrough. Likewise, the first and second LED modules 332, 334 of the LED light engine 330 may preferably be connected in either series or parallel depending upon the power consumption utilized and the current required for each of the LED modules to provide a desired illumination output of the LED light bulb 300. It too can be understood that the socket 360 electrically connected to the internal circuitry 350 and to the LED light engine 330 via lead wires 356, 358 thereof may be of any type of sockets including Edison or pin-type sockets.

Figure 11:
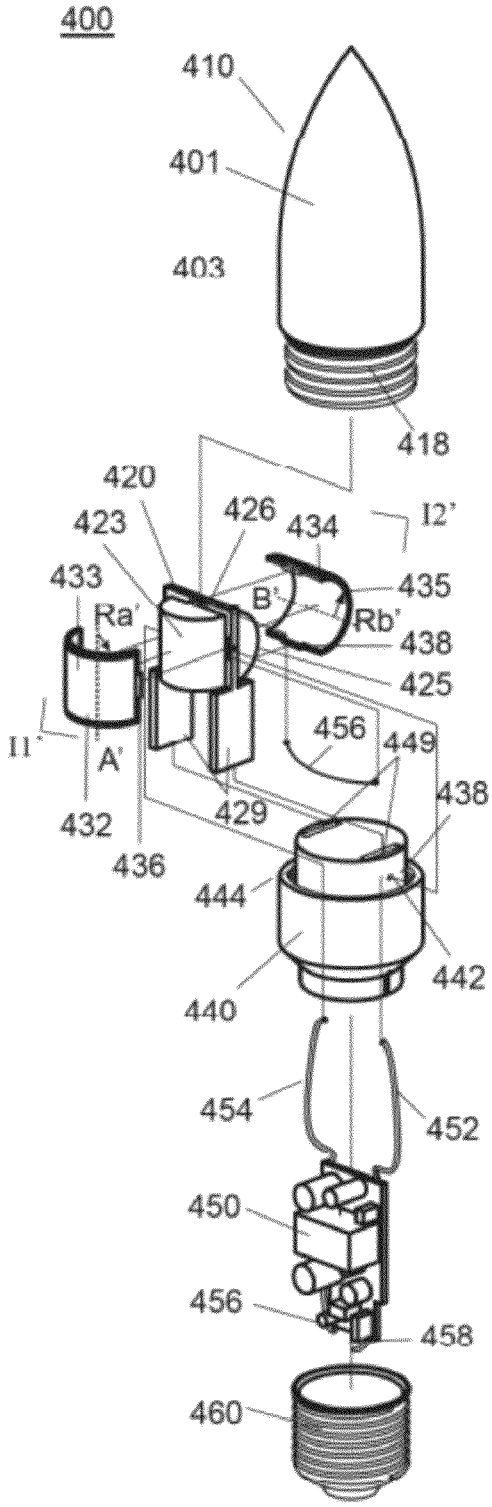
FIG. 11 is an exploded view of the LED light bulb in FIG. 9.

Referring now to FIGS. 9 and 11, there are shown an LED light bulb 400 having an LED light engine 430 in a different orientation according to a further exemplary embodiment of the present invention. The LED light bulb 400 comprises an LED light engine 430 having first and second LED modules 432, 434 with illuminated curved surfaces 433, 435 attached to a thermally conducive support block 420 extending toward and secured onto a base 440 of the light bulb 400 along a longitudinal axis C thereof. In an explanatory example, the LED light engine 430 may preferably be enclosed by a light transmissive shell 410 defining an inner space 401 thereof. The LED light bulb 400 may too be encompassed by first and second illumination zones I1', I2', and wherein said first and second illumination zones I1', I2' may include different sides of the LED light bulb 400 or said first illumination zone I1' may be different from said second illumination zone I2' and vice versa. In addition, the base 440 attached to said shell 410 along the longitudinal axis C of the light bulb 400 may too further comprise a supporting stand 448 configured to include fixation portions 449 for the securement of at least a portion of the support block 420 thereon.

The LED light engine 430 of the LED light bulb 400 may be configured to have a different structural configuration and orientation while providing an improved illumination having direct lights shone or projected to at least six different sides of the first and second illumination zones I1', I2' of the light bulb 400 such that a substantially spherical illumination of dispersed lights may be advantageously obtained. In an explanatory example as shown in FIGS. 9 and 11, the abovementioned first illumination zone I1' of the LED light bulb 400 may include at least a portion of front, left and right sides of the light bulb 400 with respect to said longitudinal axis C of the light bulb 400 and said second illumination zone I2', different from said first illumination zone I1', may include at least a portion of rear, top and bottom sides of light bulb 400 with respect to said longitudinal axis C of the light bulb 400. Similarly, the LED light engine 430 may comprise a first LED module 432 attached to a first projecting surface 423 of the support block 420 and a second LED module 424 attached to a second projecting surface 425 of the support block 420. The first LED module 432 may further comprise a first illuminated curved surface 433 facing toward the first illumination zone I1, curved about a first center axis A' with a first radius Ra' and extending along said first center axis A'; whereas the second LED module 434 may further comprise a second illuminated curved surface 435 facing toward said second illumination zone I2', curved about a second center axis B' with a second radius Rb' and extending along said second center axis B'. As shown in FIGS. 9 and 11, the LED light engine 430 of the LED light bulb 400 and the curved first and second LED modules 432, 434 thereof may be arranged on lateral sides along the longitudinal axis C of the light bulb 400. In an explanatory example, the first illuminated curved surface 433 of the first LED module 432 may be of a first half-cylindrical shape, facing toward said first illumination zone I1' on a first lateral side of the light bulb, curved about said first center axis A' with a first radius Ra'; said second illuminated curved surface 435 of the second LED module 434 may be of a second half-cylindrical shape, facing toward said second illumination zone I2' on a second lateral side of the light bulb, curved about said second center axis B' with a second radius Rb'. Similarly, the first center axis A' of the first illuminated curved surface 433 of the first LED module 432 may be arranged at an angle ∠A'B' with the second center axis B' of the second illuminated curved surface 435 of the second LED module 434; furthermore, in accordance with the configuration of the first and second illuminated surfaces 433, 435 of the first and second LED modules 432, 434 of the LED light engine 430, said angle ∠A'B' may be substantially equivalent to 90 degrees. In a further explanatory example, said angle ∠A'B' may preferably be formed on a plane substantially parallel to or along with the longitudinal axis C of the light bulb 400. It too can be understood that other degree of said angle ∠A'B', such as an angle between 30 and 150, is also possible.

Furthermore, the thermally conductive support block 420 of the LED light bulb 400 of the present invention may be further configured to facilitate the attachment of the LED light engine 430 thereon as well as the securement thereof to the base 440. The support block 420 may further comprise a first projecting surface 423, a second projecting surface 425 and a central stem 429 extending away from said first and second projecting surfaces 423, 425 along the longitudinal axis C of the light bulb 300 and secured to the supporting stand 448 of the base 440. In addition, said first projecting surface 423 of the support block 420 may further include a first outwardly-projecting convex profile toward the first illumination zone I1', and said second projecting surface 425 thereof may include a second outwardly-projecting convex profile toward the second illumination zone I2' different from the first illumination zone I1'. In an explanatory example, the support block 420 may further include a central plate 426 configured or formed between said first and second projecting surfaces 423, 425 such that an electrical connection, for example lead wire 456, may be attached or formed thereon to electrically connect electrode sets 436, 438 of first and second LED modules 432, 434 the LED light engine 430. The central plate 436 of the support block 420 may be integrally formed with the central stem 429 as one piece, by means of for example molding, injection or extrusion and for further securement to the supporting stand 448 of the base 440, via such as fixation portions 449 thereof. It too can be understood that the central stem 429, central plate 426 and support block 420 may also be integrally formed with the supporting stand 448 of the base 440 as one piece to enhance the structural stability as a whole and to facilitate the heat dissipation from the LED light engine 430 to and away from the support block 420 via the central stem 429 thereof to the base 440 and subsequently to the bulb shell 410 of the light bulb and the ambient.

For the assembly and electrical connections of the LED light bulb 400 of the present invention, components of the light bulb may be electrically connected to each other via such as lead wires and may too be attached or adjoined to each other by means of for example adhesives, fastening threads, press-fitting, slots and locks and fixations such as screws and bolts and so forth. The first and second LED modules 432, 434 of the LED light engine 430 attached to the thermally conducive support block 420 may too be formed of first and second electrode sets 436, 438 respectively and may too be electrically connected via for example lead wire 456, which may then be electrically connected to an internal circuitry 450 via for example lead wires 452, 454 thereof. As previously mentioned, the central stem 429 of the support block 420 may be further secured to the supporting stand 448 of the base 440, via for example fixation portions 449, by means of such as adhesives, press-fitting, slots and locks and fixations such as screws and bolts and so forth. Furthermore, the base 440 as well as the support block 420, or central plate 426 thereof, may too further include perforations 442, 444 configured thereon to facilitate the electrical connections, such as lead wires 452, 454, 456 to pass therethrough. Likewise, the first and second LED modules 432, 434 of the LED light engine 430 may preferably be connected in either series or parallel depending upon the design of the power consumption utilized and the current required for the LED modules to provide a desired illumination output. It can also be understood that the socket 460 electrically connected to the internal circuitry 450 and to the LED light engine 430 via such as lead wires 456, 458 may be of any type of sockets including such as Edison or pin-type sockets.

Figure 12:
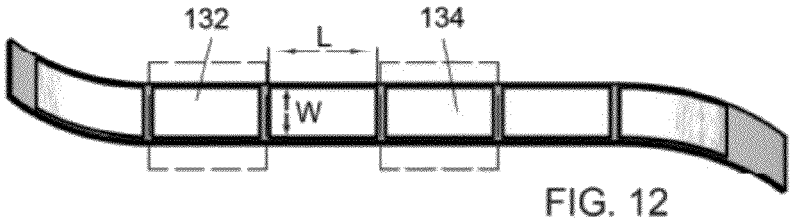
FIG. 12 is a schematic perspective view of a manufactured LED light sheet.

FIG. 12 depicts an explanatory example of an LED light sheet. As previously mentioned, an LED light sheet may be advantageously manufactured by for example roll-to-roll manufacturing processes such as the previously mentioned U.S. Pat. No. 7,033,850 entitled "Roll-to-sheet Manufacture of OLED Materials" by Tyan et al. and U.S. Pat. No. 7,259,030 entitled "Roll-to-roll Fabricated Light Sheet and Encapsulated Semiconductor Circuit Devices" by Daniels et al. In an illustrative example, first and second LED module 132, 134 of a desired and preferably consistent specification in terms of such as light spectrum, color, performance, power consumption may be made or fabricated from the LED light sheet to have a dimension of length L and width W. The LED light sheet may be either rigid or flexible sheets depending upon the substrates or materials thereof. In one example, it may be of predetermined flexibility such that first and second LED modules 132, 134 with illuminated curved surfaces 133, 134 may preferably be formed therefrom. It can be understood that the flexibility of the LED light sheet may refer to the degree of curvature of the light sheet, preferably without structural cracks or defects at the curved or arched areas or parts of the light sheet under normal operating temperature of LED light bulbs of approximately 60 degree Celsius for OLEDs and 120 degree Celsius for high power inorganic LED and under an ambient temperature of approximately 20 degree Celsius. In one exemplary embodiment, the first and second LED modules of an LED light engine of the LED light bulb of the present invention may be formed of a solid state lighting material having a curved profile, and said solid state lighting material may be selected from or made from any one of the following of top-emitting OLED, bottom-emitting OLED, transparent OLED, flexible OLED, flexible inorganic LED and a combination thereof.

Figure 13B:
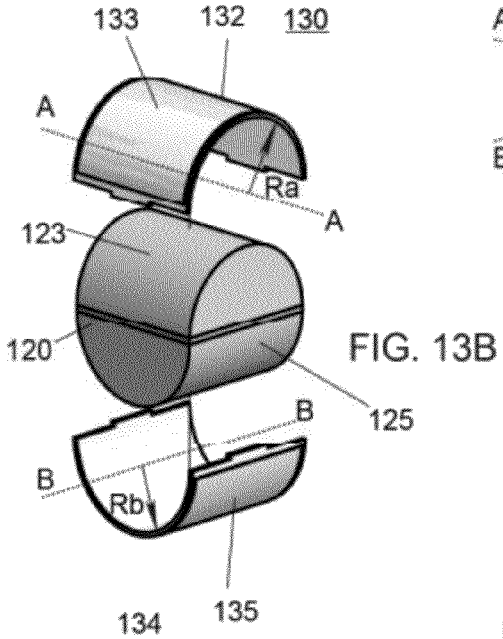
FIG. 13B is an exploded view of the LED light engine in FIG. 13A.
Figure 13A:
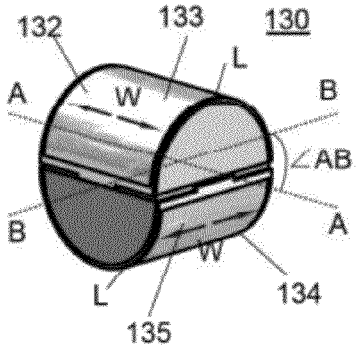
FIG. 13A is a perspective view of an embodiment of an LED light engine of an LED light bulb the present invention, utilizing the LED light sheet in FIG. 12.

FIGS. 13A and 13B illustrate an LED light engine 130 of an LED light bulb of the present invention in further details and may serve as a further emphasis to the scope and spirit of the present invention. References may too be made to the above-mentioned various exemplary embodiments of the present invention including such as LED light bulb 100, 200 and 300 of the present invention. The LED light engine 130 may utilize the abovementioned first and second LED modules 132, 134 of an LED light sheet in FIG. 12 and arranged in a novel way to provide an improved illumination. The LED light engine 130 may be arranged on a support block 120 to enhance securement and heat transfer or dissipation thereon while providing desired illumination of direct lights shone or projected to multiple directions. As previously mentioned, the first LED module 132 may be attached to the first projecting surface 123 of the support block 120, preferably with the length L thereof matching the circumferential length or edge of the support block 120; the second LED module 134 may too be attached to the second projecting surface 125 of the support block 120 and too preferably with the length L thereof matching the circumferential length or edge of the support block 120. The first illuminated curved surface 133 of the first LED module 132 may be curved about the first center axis A with a first radius Ra and extending along said first center axis A; similarly, the second illuminated curved surface 135 may be curved about a second center axis B with a second radius Rb and extending along said second center axis B. The first center axis A of the first illuminated curved surface 133 of the first LED module 132 may be preferably arranged at an angle ∠AB with the second center axis B of the second illuminated curved surface 135 of the second LED module. In an explanatory example, the angle ∠AB may be substantially equivalent to 90 degrees. Furthermore, in another explanatory example, the value of the radii Ra and Rb or the curvature of the first and second LED modules 132, 134 may be substantially greater than or equal to 5 mm; in a preferred example, the radii may be between 5 mm and 60 mm depending upon the availability of the inner space provided by the bulb shell and dimensions and shapes thereof.

It too can be understood that the dimensions of the length L and width W may be selected or predetermined depending upon the size and dimension of the light bulb and such that the value of the radii Ra, Rb of the LED modules of the LED light engine utilized therein may then be selected accordingly to provide a maximum curved surface area possible with respect to the curvature or flexibility of the LED light sheet for an improved illumination with direct lights as well as for heat dissipation. For a suggested result of illumination of first and second illumination zones of the LED light engine or light bulb, the length L and width W of the LED modules of the LED light engine thereof may be selected to be of appropriate values such that rectangular areas of direct lights may be preferably obtained at six different sides of the first and second illumination zones of the LED light engine or light bulb. In an explanatory example the width W may be predefined to be equal to twice the value of the above-mentioned curved radii Ra, Rb of the curved LED modules and Ra and Rb may be predetermined to be of the same value (i.e. W=2Ra or 2Rb), then based on an apparent geometric relationships of an arched or curved surface having a curved radius Ra or Rb with a extension of width W as shown in FIGS. 13A and 13B, the length L referring to a half-circumferential length of the curved first or second LED module with radii Ra or Rb (i.e. L=Raπ or Rbπ) may be correlated to the width W of the LED light sheet in a planar form with a ratio of 1/2π (i.e. L:W=1/2π:1) and such that rectangular area of direct lights projected to different sides of the illumination zones may preferably be obtained. In another explanatory example, said first and second illuminated curved surfaces 133, 135 of the first and second LED modules 132, 134 may extend along said first and second center axes Ra, Rb respectively to a width W substantially greater than or equal to 5 mm or may be preferably between 5 mm and 60 mm depending upon the availability of the inner space provided by the type of the bulb shell and dimensions thereof. In an illustrative instance of the present invention, an LED light bulb of the present invention of an A60-type light bulb having a bulb shell of a diameter of 60 mm is provided; accordingly, an LED light engine comprising first and second LED modules 132, 134 with illuminated curved surfaces 133, 135 having curved radii Ra, Rb of for example 20 mm may be selected and fabricated from the LED light sheets in a planar of a suggested dimension having a width W of 40 mm and a length L of 63 mm (20 mm·1/2π) such that direct lights may be provided to rectangular illumination areas projected from the LED modules 132, 134 of the LED light engine 130 to at least six different sides of the illumination zones of the LED light bulb; and wherein each of the top and bottom rectangular illumination areas immediately projected from the illuminated curved surfaces of the LED modules may be of a square projected illumination area with a dimension of 1,600 $mm^2$ (40 mm (2Ra)·40 mm (W)); each of lateral sides of front, rear, right and left rectangular illumination areas immediately projected from the illuminated curved surfaces of the LED modules may be of a dimension of 800 $mm^2$ (20 mm (Ra)·40 mm (W)). In a further illustrative example, the first and second LED modules 132, 134 may be fabricated to be of an elongated shape with the semi-circular edges (not shown) such that the entire surface areas of the support block 120 may be substantially covered or encompassed by the LED light engine 130.

Figure 14A:
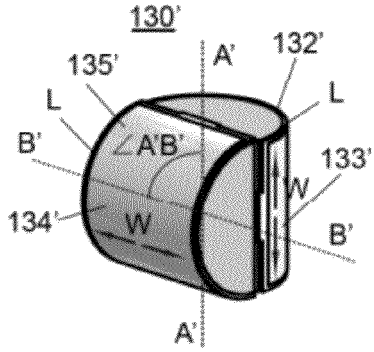
FIG. 14A is a perspective view of another embodiment of an LED light engine of an LED light bulb the present invention, utilizing the LED light sheet in FIG. 12.
Figure 14B:
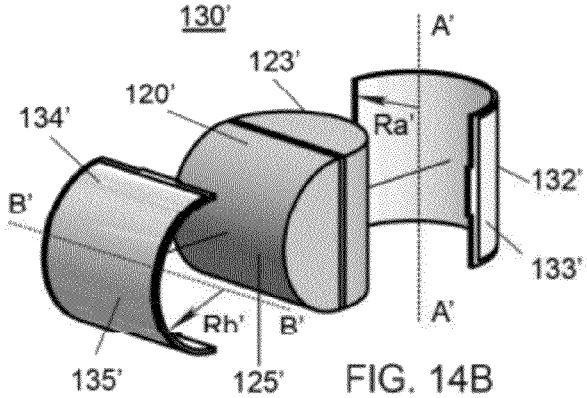
FIG. 14B is an exploded view of the LED light engine in FIG. 14A.

Similarly, FIGS. 14A and 14B show another explanatory embodiment of an LED light engine 130' of an LED light bulb of the present invention and references may too be made to the abovementioned exemplary embodiment of the present invention, for instance, LED light bulb 400 of the present invention. The first and second LED modules 132', 134' of the LED light engine 130' may too be made from the LED light sheet as shown in FIG. 12. Either one of the LED light engines 130, 130' may provide an improved illumination having direct lights shone or projected to at least six different sides of the light engine or light bulb. Also, in one preferred example, said first and second illuminated curved surfaces 133', 135' of the first and second LED modules 132', 134' may extend along said first and second center axes Ra', Rb' respectively to a width W substantially greater than or equal to 5 mm; preferably between 5 mm and 60 mm depending upon the availability of the inner space provided by the bulb shell and dimensions thereof. In another illustrative example, an LED light bulb of the present invention of an B38-type light bulb having a bulb shell of a diameter of 38 mm is provided; accordingly, an LED light engine comprising first and second LED modules with illuminated curved surfaces having curved radii Ra, Rb of for example 15 mm may be fabricated from the LED light sheets in a planar of a suggested dimension having a width W equal of 30 mm (2Ra) and a length L of approximately 47 mm (1/2 W π) such that direct lights may be projected from rectangular illumination areas of the LED modules of the LED light engine to at least six different sides of the illumination zones of the LED light bulb; furthermore, as the LED modules of the LED light engine 130' may be in a different orientation; each of the front and area rectangular illumination areas immediately projected from the illuminated curved surfaces of the LED modules may be of a dimension of 900 $mm^2$ (30 mm (2Ra)·30 mm (W)); each of the other sides of top, bottom, right and left rectangular illumination areas immediately projected from the illuminated curved surfaces of the LED modules may be of a dimension of 450 $mm^2$ (15 mm (Ra)·30 mm (W)). In a further illustrative example, the first and second LED modules 132', 134' may be fabricated or configured to be of an elongated shape with the semi-circular edges (not shown) such that the entire surface areas of the support block 120' may be substantially covered, enclosed or encompassed by the LED light engine 130'. Similarities and differences among different orientations of the LED light engines of the present invention are further illustrated in the subsequent content.

Figure 15A:
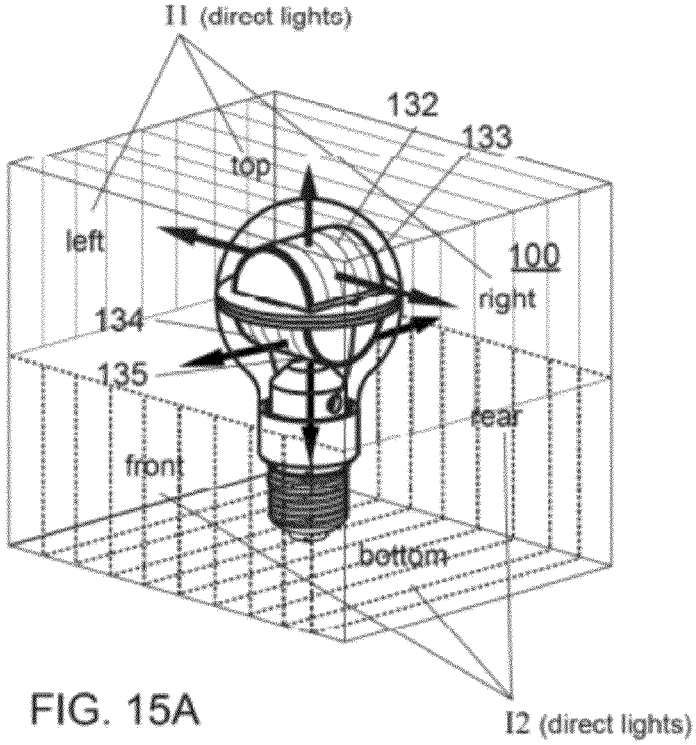
FIG. 15A is a schematic view showing first and second illumination zones of an embodiment of an LED light bulb of the present invention.

FIG. 15A show schematic representations of different embodiments of an LED light bulb of the present invention. As shown in FIG. 15A, an LED light bulb 100 according to an exemplary embodiment of the present invention may provide illumination to first and second illumination zones I1, I2; or in other words, the shell and the LED light bulb 100 may be encompassed by the first and second illumination zones I1, I2 and the abovementioned angle ∠AB between the first and second center axes A, B of the first and second LED modules 132, 134 o the LED light engine 130 may be preferably formed on a plane substantially perpendicular to said longitudinal axis C of the light bulb 100. In an explanatory example, said first illumination zone I1 may include at least a portion of top and two lateral sides, such as left and right sides, of the light bulb 100 with respect to said longitudinal axis C of the light bulb, and said second illumination zone I2 may be different from said first illumination zone I1 including at least a portion of bottom, and the other two lateral sides, such as front and rear sides, of light bulb 100 with respect to said longitudinal axis C of the light bulb. As shown in the figure, the first illumination zone I1 with direct lights shone or projected from the first LED module 132 of the LED light engine 130 is depicted by "solid lines" on the illustrative projected sides of the light bulb; and whereas the first illumination zone I2 shone and covered by the second LED module 134 is represented by "dashed lines". In short, each one of the abovementioned first and second LED modules 132, 134 of the LED light engine 130 may be arranged to provide an illumination of direct lights to at least three sides of the light bulb.

Figure 15B:
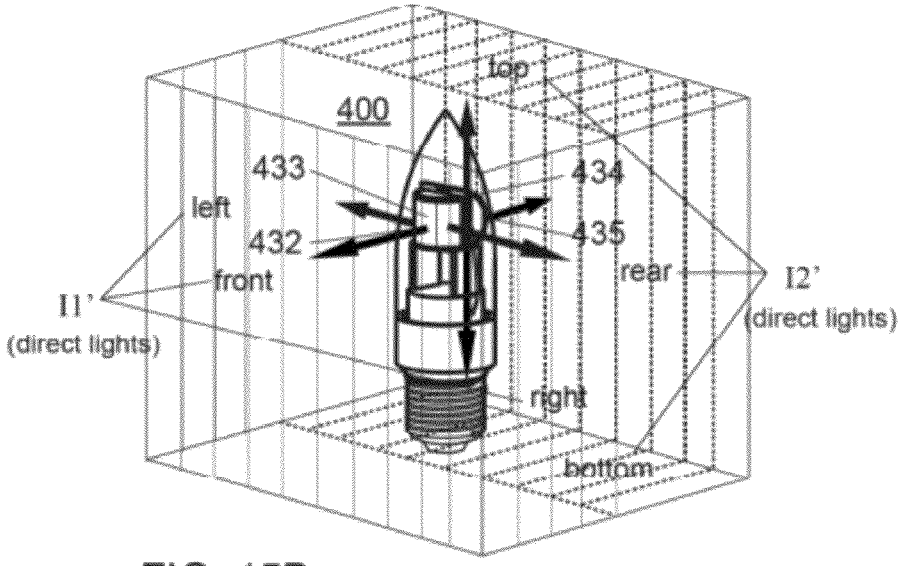
FIG. 15B is a schematic view showing first and second illumination zones of another embodiment of an LED light bulb of the present invention.

Similarly, FIG. 15B is another explanatory illustration showing another embodiment of an LED light bulb 400 encompassed by first and second illumination zones I1', I2' and with imaginary surfaces or sizes of an illuminated box projected from the LED light bulb aimed to illustrate the principle of an improved illumination of the present invention. As previously mentioned in FIGS. 14A and 14B, different orientations of an LED light engine of the present invention may be possible, the LED light bulb 400 may comprise an LED light engine and the abovementioned angle A'B' between the first and second center axes A', B' of the first and second LED modules 432, 434 o the LED light engine 430 may be preferably formed on a plane substantially parallel to said longitudinal axis C of the light bulb 410. The first LED module 432 may emit direct lights to a first illumination zone I1' including at least a portion of front, left and right sides of the light bulb 400 with respect to said longitudinal axis C of the light bulb and the second LED module 434 may project direct lights to a second illumination zone I2' including at least a portion of rear, top and bottom sides of light bulb 400 with respect to said longitudinal axis of the light bulb.

Figure 16:
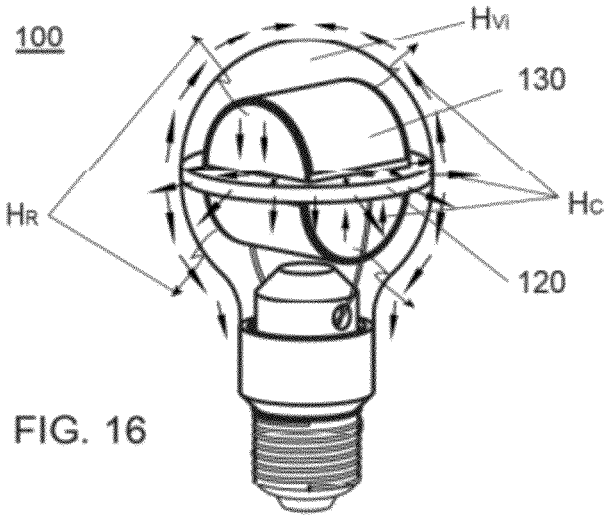
FIG. 16 is a schematic view showing heat dissipations of an embodiment of an LED light bulb of the present invention.
Figure 17:
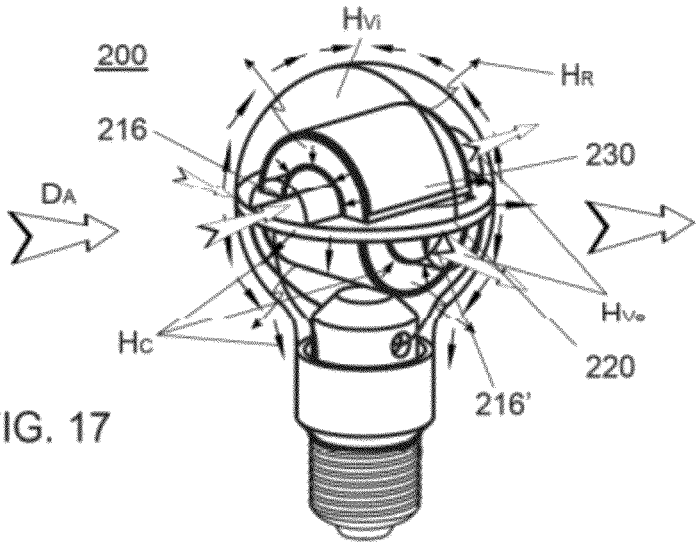
FIG. 17 is a schematic view showing heat dissipations of another embodiment of an LED light bulb of the present invention.
Figure 18:
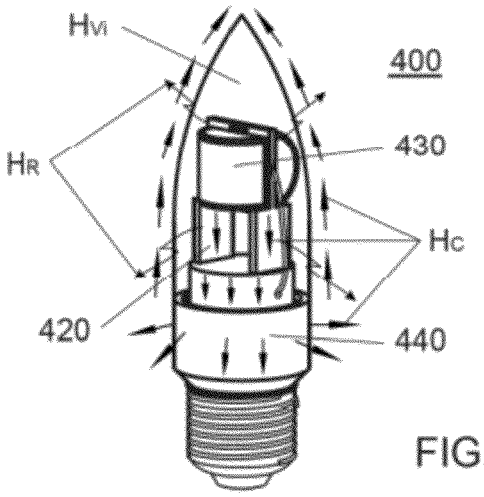
FIG. 18 is a schematic view showing heat dissipations of still another embodiment of an LED light bulb of the present invention.

FIGS. 16~18 are explanatory illustrations showing heat dissipation of different embodiments of an LED light bulb of the present invention in an upright position. To demonstrate the heat dissipation of the LED light engine or light source of an LED light bulb of the present invention, the previously mentioned exemplary embodiments of the LED light bulbs 100, 200 and 400 of the present invention are illustratively shown. As shown by the "arrows" in the figures, heat generated by an LED light engine during operation may be dissipated via conduction $H_C$, convection $H_{Vi}$ of an internal gas and convection of ambient air $H_{VO}$ as well as radiation $H_R$. In FIG. 16, the LED light engine 130 of the LED light bulb 100 of the present invention may be effectively cooled as heat may be conducted away from the LED light engine 130 toward the bulb shell via the support block 120. As the curved surface area of the LED light engine 130 having an curved profile is increased, the heat dissipation from the heat source (light source) may too be enhanced. In addition to the conduction of heat $H_C$, the heat may too be dissipated by ways of radiation $H_R$ and convection $H_{Vi}$ of an internal gas and subsequently utilizing the entire surface of the shell and structures at the front portion of the light bulb for forward cooling to dissipate the heat to the ambient effectively and efficiently. In FIG. 17, air channels 216, 216' are further introduced and provided on the LED light bulb 200 of the present invention. In addition to the above mentioned heat conduction $H_C$, convection $H_{Vi}$ of the internal gas and radiation $H_R$, the cooling of a high power LED light engine 230 may be further enhanced by the convention of ambient air $H_{VO}$, represented by the direction of air flow "$D_A$" in the figure, flowing through the air channels 216, 216'. FIG. 18 shows another exemplary embodiment of an LED light bulb 400 of the present invention, the conductive structure of a support block 420 having a central stem extending toward and attached to the base 440 too provides an effective heat conduction means allowing heat to be transmitted away from the LED light engine 430 and support block 420 subsequently utilizing the entire surface of the shell and structures at the front portion of the light bulb for forward cooling to dissipate the heat to the ambient effectively and efficiently.

The materials disclosed herein are for illustrative purposes and aimed to facilitate the realization of various explanatory embodiments of the present invention only, which shall not be treated as limitations to the present invention. First of all, the shell or envelope of an LED light bulb of the present invention may be formed of a transparent material with or without surface treatment. The transparent material of the shell may include glass, silicon based material, plastic, or transparent ceramics such as transparent alumina ($Al_2O_3$) and boron nitride (BN) or hexagonal boron nitride (hBN). In short, the light transmissive shell of the LED light bulb of the present invention may be formed of any one of the following materials of glass, quartz, aluminum oxide, boron nitride, plastics and a combination thereof. For an enhanced mechanical property, the shell of the LED light bulb of the preset invention may be preferably formed of ceramics or surface treated with ceramic materials including such as transparent alumina or transparent boron nitride. Furthermore, an example of a transparent ceramic may too be provided by General Electric Company (GE) and marketed as Lucalox® ceramic, a polycrystalline translucent aluminum oxide ceramic. It exhibits high dielectric strength and is also capable of transmitting a wide spectrum of wavelengths including visible spectrums while having the property of high thermal conductivity. The outer surface of the shell may also be further treated with surface irregularities to reflect and/or refract lights for dispersed lights. As previously mentioned, the shell may be of various forms and shapes according to different standards including A/G/PS type bulbs. To further enhance heat dissipation of the LED light engine enclosed within the inner space of the bulb shell of the LED light bulb of the present invention, the inner space of the shell may be filled with an internal gals or fluid. In one embodiment, the inner space may be evacuated to contain at least a partial vacuum and/or filled with a high thermal conductive medium or internal gas, preferably inert, such as helium, argon, nitrogen, carbon dioxide, hydrogen, metal halides and a mixture thereof such that heat dissipation may be further enhanced by conduction/convection of the internal gas to the shell and subsequently to the ambient.

Furthermore, the thermally conductive structures including for example the support block and the base of the LED light bulb of the present invention may too be made of, or surface treated with, materials of high or relatively good thermal conductivity; for example, ceramic, carbon composite, metal or metal alloy and a combination thereof, to facilitate the heat transferred from the LED light source. It may also be preferable that the conductive structures are made of, or surface treated with, a dielectric material such that it acts as an insulation to prevent reaction with an internal gas and/or to prevent possible electric leakage conducted from the LED light engine or the support block. Accordingly, the support block and/or the base of the LED light bulb of the present invention may be formed of any one of the following thermally conductive materials of silica, aluminum oxide, boron nitride, carbon composite, metal, metal alloy and a combination thereof. Furthermore, said support block and/or the base of the LED light bulb of the present invention may further comprise an electrical insulation coating formed of any one of the following of boron nitride coating, aluminum oxide coating, acrylic coating, epoxy coating, silicone coating, polyurethane coating and a combination thereof. In a preferred embodiment, the thermally conductive material is a ceramic with good thermal conductivity such as aluminum nitride (AlN) or boron nitride. It may too be preferable that the conductive structures are made of transparent ceramics such as transparent alumina or hexagonal boron nitride (hBN). As shown in various embodiments of an LED light bulb of the present invention, parts and elements of the LED light bulb may be integrally formed as one piece of a material. In addition, the base may too be formed of a dielectric material such as plastic with a metal contact socket such as an Edison socket as the end cap. In another embodiment, said base of the LED light bulb of the present invention configured to receive an internal circuitry therein may too be formed of a dielectric material such as plastic. Furthermore, the internal circuitry utilized therein may be selected in accordance with the types of LED used, including for example, direct current (DC) and alternate current (AC) LED or OLED. In one embodiment in which the LED light engine may include an AC OLED module such that the dimension of the base of the light bulb may be reduced to include electronic component(s) such as resistor, capacitor and/or positive temperature coefficient (PTC) thermistor. For a DC LED or OLED light engine of an LED light bulb of the present invention, the base of the light bulb may include an internal circuitry having a power supply, AC/DC-converter, driver and/or bridge.

The claims in the subsequent content should not be read as limitations to the described order or elements unless stated to that effect. While the invention has been particularly shown and described with reference to specific illustrative embodiments, it should be understood that various changes in form and detail may be made without departing from the spirit and scope of the invention as defined by the appended claims. Furthermore, any of the disclosed features may be combined with any of the other disclosed features to form parts of the LED light bulb of the present invention as one integral piece. It too can be understood that the directional terms of "left", "right", "front", "rear", "top" and "bottom" recited herein are being used to best describe the orientation and configuration of the present invention and are provided mainly to illustrate and emphasize the principle of an improved illumination having direct lights shone or projected to multiple directions and sides of an LED light bulb of the present invention; any other assignment of terms, wording or references shall too be considered within the spirit and scope of the present invention. It may too be understood that the term "without" recited herein is also to emphasize differences among embodiments of the present invention only; for example, the embodiment where a cooling without excess use of moving parts does not exclude the use or scope of a light bulb having rotary fans. Therefore, all embodiments that come within the scope and spirit of the following claims and equivalents thereto are claimed as the invention.

The embodiments of the invention in which an exclusive property or privilege is claimed are defined as follows:

1. An LED light bulb encompassed by a first illumination zone and a second illumination zone different from said first illumination zone, comprising:

a light transmissive shell defining an inner space;

a thermally conductive support block comprising a first projecting surface and a second projecting surface away from said first projecting surface;

an LED light engine arranged on said support block, comprising a first LED module attached to said first projecting surface of the support block and a second LED module attached to said second projecting surface of the support block; wherein said first LED module comprises a first illuminated curved surface facing toward said first illumination zone, curved about a first center axis and extending along said first center axis; wherein said second LED module comprises a second illuminated curved surface facing toward said second illumination zone, curved about a second center axis and extending along said second center axis; and wherein said first center axis of the first illuminated curved surface is arranged at an angle with said second center axis of the second illuminated curved surface; and a base attached to the shell along a longitudinal axis of the light bulb and configured to receive an internal circuitry electrically connected to the LED light engine.

2. The LED light bulb according to claim 1, wherein said angle between said first and second center axes of the first and second illuminated curved surfaces of the first and second LED modules of the LED light engine is substantially equivalent to 90 degrees.

3. The LED light bulb according to claim 1, wherein said angle between said first and second center axes of the first and second illuminated curved surfaces of the first and second LED modules of the LED light engine is formed on a plane substantially perpendicular to said longitudinal axis of the light bulb.

4. The LED light bulb according to claim 1, wherein said angle between said first and second center axes of the first and second illuminated curved surfaces of the first and second LED modules of the LED light engine is formed on a plane substantially parallel to said longitudinal axis of the light bulb.

5. The LED light bulb according to claim 3, wherein said first illumination zone includes at least a portion of top, left and right sides of the light bulb with respect to said longitudinal axis of the light bulb, and said second illumination zone different from said first illumination zone includes at least a portion of bottom, front and rear sides of light bulb with respect to said longitudinal axis of the light bulb; whereby said first LED module of the LED light engine provides direct lights to said top, left and right sides of the light bulb and said second LED module of the LED light engine provides direct lights to said bottom, front and rear sides of the light bulb.

6. The LED light bulb according to claim 4, wherein said first illumination zone includes at least a portion of front, left and right sides of the light bulb with respect to said longitudinal axis of the light bulb, and said second illumination zone different from said first illumination zone includes at least a portion of rear, top and bottom sides of light bulb with respect to said longitudinal axis of the light bulb; whereby said first LED module of the LED light engine provides direct lights to said front, left and right sides of the light bulb and said second LED module of the LED light engine provides direct lights to said rear, top and bottom sides of the light bulb.

7. The LED light bulb according to claim 1, wherein said first illuminated curved surface of the first LED module is of a first half-cylindrical shape curved about said first center axis with a first radius, and said second illuminated curved surface of the second LED module is of a second half-cylindrical shape curved about said second center axis with a second radius.

8. The LED light bulb according to claim 1, wherein said support block further comprises a first conductive block having said first projecting surface formed thereon with a first outwardly-projecting convex profile toward said first illumination zone and a second conductive block having said second projecting surface formed thereon with a second outwardly-projecting convex profile toward said second illumination zone.

9. The LED light bulb according to claim 1, wherein said support block further comprises a thermally conductive central plate configured between said first and second projecting surfaces.

10. The LED light bulb according to claim 1, wherein said support block further comprises a central stem extending away from said first and second projecting surfaces thereof along said longitudinal axis of the light bulb and further secured to said base of the light bulb.

11. The LED light bulb according to claim 1, wherein said light transmissive shell further comprises a first envelope and a second envelope enclosing said inner space thereof; and wherein said first and second envelopes of the shell further comprises at least one inwardly convex profile projecting toward said inner space thereof such that at least one air channel is formed on said shell to allow ambient air passing therethrough.

12. The LED light bulb according to claim 1, wherein said first and second LED modules of the LED light engine are formed of a solid state lighting material selected from any one of the following: top-emitting OLED, bottom-emitting OLED, transparent OLED, flexible OLED, flexible inorganic LED and a combination thereof.

13. The LED light bulb according to claim 1, wherein said light transmissive shell is formed of any one of the following materials: glass, quartz, aluminum oxide, boron nitride, plastics and a combination thereof.

14. The LED light bulb according to claim 1, wherein said support block is formed of any one of the following thermally conductive materials: silica, aluminum oxide, boron nitride, carbon composite, metal, metal alloy and a combination thereof.

15. The LED light bulb according to claim 1, wherein said inner space of the shell is evacuated to contain at least a partial vacuum and filled with a thermal conductive medium selected from any one of the following gases: helium, argon, nitrogen, carbon dioxide, hydrogen, metal halides and a mixture thereof.

16. An LED light bulb encompassed by a first illumination zone and a second illumination zone different from said first illumination zone, comprising:

a light transmissive shell defining an inner space enclosed by a first envelope and a second envelope;

a thermally conductive support block comprising a first projecting surface and a second projecting surface; wherein said first projecting surface includes a first outwardly-projecting convex profile toward said first envelope of the shell; and wherein said second convex surface includes a second outwardly-projecting convex profile toward said second envelope of the shell;

an LED light engine attached to said support block, comprising a first LED module attached to said first projecting surface of the support block and a second LED module attached to said second projecting surface of the support block; wherein said first LED module comprises a first illuminated curved surface facing toward said first illumination zone, curved about a first center axis and extending along said first center axis; wherein said second LED module comprises a second illuminated curved surface facing toward said second illumination zone, curved about a second center axis and extending along said second center axis; and wherein said first center axis of the first illuminated curved surface is arranged at an angle substantially perpendicular to said second center axis of the second illuminated curved surface; and a base attached to the shell along a longitudinal axis of the light bulb and configured to receive an internal circuitry electrically connected to the LED light engine.

17. The LED light bulb according to claim 16, wherein said angle between said first and second center axes of the first and second illuminated curved surfaces of the first and second LED modules of the LED light engine is formed on a plane substantially perpendicular to said longitudinal axis of the light bulb.

18. The LED light bulb according to claim 16, wherein said first illuminated curved surface of the first LED module is of a first half-cylindrical shape curved about said first center axis with a first radius, and said second illuminated curved surface of the second LED module is of a second half-cylindrical shape curved about said second center axis with a second radius.

19. The LED light bulb according to claim 18, wherein said first radius of the first illuminated curved surface of the first LED module and said second radius of the second illuminated curved surface of the second LED module are substantially equivalent to each other and are of a value substantially greater than or equal to 5 mm.

20. The LED light bulb according to claim 16, wherein said first and second illuminated curved surfaces of the first and second LED module extend along said first and second center axes respectively to a width substantially greater than or equal to 5 mm.

21. The LED light bulb according to claim 16, wherein said support block further comprises a thermally conductive central plate configured between said first and second projecting surfaces.

22. The LED light bulb according to claim 16, wherein said first and second envelopes of the shell further comprises a first-half piece and a second-half piece adjoined to each other along said longitudinal axis of the light bulb.

23. The LED light bulb according to claim 16, wherein said first and second envelopes of the shell further comprises at least one inwardly convex profile projecting toward said inner space thereof such that at least one air channel is formed on said shell to allow ambient air passing therethrough.

24. The LED light bulb according to claim 23, wherein said support block further comprises a first conductive block having said first projecting surface formed thereon and a second conductive block having said second projecting surface formed thereon; and wherein said first and second conductive blocks further comprises an inwardly curved surface coincide with said at least one inwardly convex profile on said first and second envelops of the shell to encompass at least a portion of said at least one air channel.

25. The LED light bulb according to claim 16, wherein said first and second LED modules of the LED light engine are formed of a solid state lighting material selected from any one of the following: top-emitting OLED, bottom-emitting OLED, transparent OLED, flexible OLED, flexible inorganic LED and a combination thereof.

26. An LED light bulb encompassed by a first illumination zone and a second illumination zone different from said first illumination zone, comprising:

a light transmissive shell defining an inner space;

a thermally conductive support block comprising a first projecting surface, a second projecting surface and a central stem extending away from said first and second projecting surfaces along a longitude axis of the light bulb; wherein said first projecting surface includes a first outwardly-projecting convex profile and said second projecting surface includes a second outwardly-projecting convex profile away from said first outwardly-projecting convex profile of the first project surface;

an LED light engine attached to said support block, comprising a first LED module attached to said first projecting surface of the support block and a second LED module attached to said second projecting surface of the support block; wherein said first LED module comprises a first illuminated curved surface facing toward said first illumination zone and said second LED module comprises a second illuminated curved surface facing toward said second illumination zone; wherein said first illuminated curved surface of the first LED module is of a first half-cylindrical shape curved about a first center axis with a first radius and extending along said first center axis, and said second illuminated curved surface of the second LED module is of a second half-cylindrical shape curved about a second center axis with a second radius and extending along said second center axis; wherein said first center axis of the first illuminated curved surface of the first LED module is arranged at an angle substantially perpendicular to said second center axis of the second illuminated curved surface of the second LED module; and a base comprising a supporting stand secured to said central stem of the support block, configured to receive an internal circuitry therein and attached to said shell along said longitudinal axis of the light bulb.

27. The LED light bulb according to claim 26, wherein said angle between said first and second center axes of the first and second illuminated curved surfaces of the first and second LED modules of the LED light engine is formed on a plane substantially perpendicular to said longitudinal axis of the light bulb.

28. The LED light bulb according to claim 26, wherein said angle between said first and second center axes of the first and second illuminated curved surfaces of the first and second LED modules of the LED light engine is formed on a plane substantially parallel to said longitudinal axis of the light bulb.

29. The LED light bulb according to claim 26, wherein said first radius of the first illuminated curved surface of the first LED module and said second radius of the second illuminated curved surface of the second LED module are substantially equivalent to each other and are of a value substantially greater than or equal to 5 mm; and wherein said first and second illuminated curved surfaces of the first and second LED module extend along said first and second center axes respectively to a width substantially greater than or equal to 5 mm.

30. The LED light bulb according to claim 26, wherein said first and second LED modules of the LED light engine are formed of a solid state lighting material having a curved profile, and said solid state lighting material is selected from any one of the following: top-emitting OLED, bottom-emitting OLED, transparent OLED, flexible OLED, flexible inorganic LED and a combination thereof.

* * * * *